US006615105B2

(12) United States Patent
Masotta

(10) Patent No.: US 6,615,105 B2
(45) Date of Patent: Sep. 2, 2003

(54) SYSTEM AND METHOD FOR ADJUSTING SHEET INPUT TO AN INSERTER SYSTEM

(75) Inventor: John R. Masotta, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 54 days.

(21) Appl. No.: 09/981,969

(22) Filed: Oct. 18, 2001

(65) Prior Publication Data

US 2003/0083778 A1 May 1, 2003

(51) Int. Cl.[7] ..... B65H 41/00

(52) U.S. Cl. ..... 700/219; 270/52.09; 271/3.01; 271/3.05; 271/3.17

(58) Field of Search ..... 700/219, 220, 700/221, 222, 223; 270/52.09, 52.02, 52.08, 58.08, 58.27; 271/3.01, 3.07, 3.03, 3.05, 94, 95, 3.17

(56) References Cited

U.S. PATENT DOCUMENTS

| | | | | |
|---|---|---|---|---|
| 4,939,888 A | | 7/1990 | Katz et al. | 270/52.09 |
| 5,104,104 A | | 4/1992 | Mol | 270/52.5 |
| 5,417,158 A | | 5/1995 | Parsio | 101/232 |
| 5,575,463 A | | 11/1996 | Parkander | 270/52.02 |
| 5,599,009 A | | 2/1997 | Mandel et al. | 270/58.09 |
| 5,761,535 A | | 6/1998 | Neifert et al. | 395/882 |
| 5,826,869 A | | 10/1998 | Nyffenegger et al. | 270/52.02 |
| 5,947,461 A | | 9/1999 | Holbrock | 270/52.09 |
| 6,076,824 A | | 6/2000 | Oppliger et al. | 271/150 |
| 6,095,512 A | | 8/2000 | Vijuk et al. | 271/3.05 |
| 6,131,053 A | | 10/2000 | Nyffenegger et al. | 700/220 |
| 6,189,883 B1 | | 2/2001 | Wright et al. | 271/96 |
| 6,244,584 B1 | * | 6/2001 | Holbrook et al. | 271/3.07 |
| 6,257,566 B1 | * | 7/2001 | Dooley | 270/52.18 |
| 6,257,568 B1 | | 7/2001 | Vijuk et al. | 271/3.05 |
| 6,305,680 B1 | * | 10/2001 | Allen et al. | 270/45 |
| 6,364,305 B1 | * | 4/2002 | Sussmeier et al. | 270/52.09 |
| 6,367,793 B1 | * | 4/2002 | O'Dea et al. | 270/52.09 |

* cited by examiner

*Primary Examiner*—Patrick Mackey
(74) *Attorney, Agent, or Firm*—Angleo N. Chaclas; Charles R. Malandra, Jr.; Micheal J. Cummings

(57) ABSTRACT

The present invention relates to an input system for feeding sheets from a paper web to a high speed mass mailing inserter system. Sheets of paper are separated from the paper web and are fed to a stacking module configured to receive the separated sheets, to stack the sheets, and to individually feed sheets from the stack. The rate of feeding sheets into the stacking module is adjusted as a function of the rate at which individual sheets are fed out of the stack, and as a function of the deviation of the stack height from a pre-selected nominal stack height.

43 Claims, 13 Drawing Sheets

SYSTEM AND METHOD FOR ADJUSTING SHEET INPUT TO AN INSERTER SYSTEM

RELATED APPLICATIONS

This application is related to U.S. patent application Ser. No. 09/473,586, entitled SYSTEM AND METHOD FOR PROVIDING SHEETS TO AN INSERTER SYSTEM, filed on Dec. 28, 1999 and Ser. No. 09/473,533, entitled SYSTEM AND METHOD FOR DOCUMENT INPUT CONTROL, filed on Dec. 28, 1999.

FIELD OF THE INVENTION

The present invention relates generally to multi-station document inserting systems, which assemble batches of documents for insertion into envelopes. More particularly, the present invention is directed towards the control of the input system to adjust the rate at which sheets are input into a high speed multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into the envelope. A typical modem inserter system also includes a control system to synchronize the operation of the overall inserter system to ensure that the collations are properly assembled.

In order for such multi-station inserter systems to process a large number of mailpieces (e.g., 18,000 mailpieces an hour) with each mailpiece having a high average page count collation (at least four (4) pages), it is imperative that the input system of the multi-station inserter system is capable of cycling input documents at extremely high rates (e.g. 72,000 per hour). However, currently there are no commercially available document inserter systems having an input system with the capability to perform such high speed document input cycling. Regarding the input system, existing document inserter systems typically first cut or burst sheets from a web so as to transform the web into individual sheets. These individual sheets may be either processed in a one-up format or merged into a two-up format, typically accomplished by center-slitting the web prior to cutting or bursting into individual sheets. A gap is then generated between the sheets (travelling in either in a one-up or two-up format) to provide proper page breaks enabling collation and accumulation functions. After the sheets are accumulated, they are folded and conveyed downstream for further processing. As previously mentioned, it has been found that this type of described input system is either unable to, or encounters tremendous difficulties, when attempting to provide high page count collations at high cycling speeds.

Therefore, it is an object of the present invention to overcome the difficulties associated with input stations for console inserter systems when providing high page count collations at high cycling speeds.

SUMMARY OF THE INVENTION

The present invention provides a system and method for inputting documents in a high speed inserter system to achieve high page count collations. More particularly, the present invention provides for collecting, stacking and re-feeding individual documents after they are fed from a web supply and separated in a cutting station, preparatory to collation and accumulation of the individual documents.

In accordance with the present invention, the input system includes a feeding module for supplying a paper web having the two web portions in side-by-side relationship. A merging module is located downstream in the path of travel from the feeding module and is operational to feed the two web portions in upper-lower relationship so as to reorient the paper web from the side-by-side relationship to an upper-lower relationship. A separating module is located downstream in the path of travel from the merging module and is operational to receive the paper web in the upper-lower relationship and separate the paper web into individual two-up sheets. In order to separate the two-up sheets into one-up sheets, a stacking module is located downstream in the path of travel from the separating module and is configured to receive the two-up sheets, stack the two-up sheets in a sheet pile and individually feed one-up sheets from the stack.

The rate at which one-up sheets are fed from the stack can vary, depending in part on the size of the collations to be inserted downstream. If a series of collations drawn from the stack include a large number of sheets, one-up sheets will be drawn from the stack more quickly. If a series of collations have fewer sheets, one-up sheets will be drawn from the stack less quickly. If two-up sheets are fed into stacking module at a constant speed it is likely that the stack will eventually become over-full or under-full based on the variations in the output speed of the one-up sheets.

Accordingly, in the preferred embodiment of the present invention, the rate of feeding two-up sheets into the stacking module is adjusted as a function of the rate at which one-up sheets are fed out of the stack, and as a function of the deviation of the stack height from a pre-selected nominal stack height.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
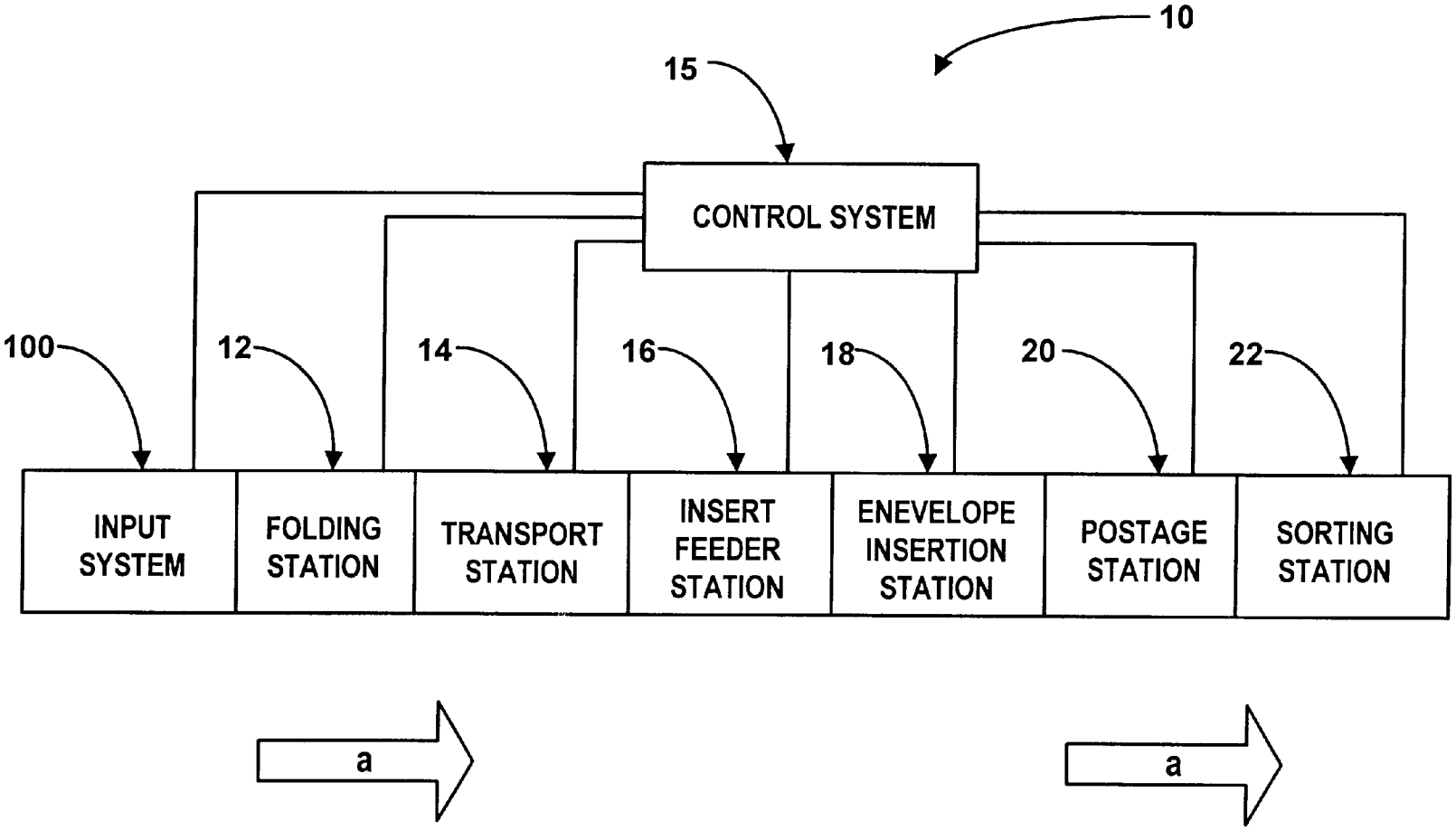
FIG. 1 is a block diagram schematic of a document inserting system in which the present invention input system is incorporated.

In describing the preferred embodiment of the present invention, reference is made to the drawings, wherein there is seen in FIG. 1 a schematic of a typical document inserting system, generally designated 10, which implements the present invention input system 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below, system 10 preferably includes an input system 100 that feeds paper sheets from a paper web to an accumulating station that accumulates the sheets of paper in collation packets. Preferably, only a single sheet of a collation is coded (the control document), which coded information enables the control system 15 of inserter system 10 to control the processing of documents in the various stations of the mass mailing inserter system. The code can comprise a bar code, UPC code or the like.

Essentially, input system 100 feeds sheets in a paper path, as indicated by arrow "a," along what is commonly termed the "main deck" of inserter system 10. After sheets are accumulated into collations by input system 100, the collations are folded in folding station 12 and the folded collations are then conveyed to a transport station 14, preferably operative to perform buffering operations for maintaining a proper timing scheme for the processing of documents in inserting system 10.

Each sheet collation is fed from transport station 14 to insert feeder station 16. It is to be appreciated that a typical inserter system 10 includes a plurality of feeder stations, but for clarity of illustration only a single insert feeder 16 is shown. Insert feeder station 16 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into an envelope insertion station 18 that is operative to insert the collation into an envelope. The envelope is then preferably conveyed to postage station 20 that applies appropriate postage thereto. Finally, the envelope is preferably conveyed to sorting station 22 that sorts the envelopes in accordance with postal discount requirements.

As previously mentioned, inserter system 10 includes a control system 15 coupled to each modular component of inserter system 10, which control system 15 controls and harmonizes operation of the various modular components implemented in inserter system 10. Preferably, control system 15 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: folding station 12, transport station 14, insert feeder station 16, envelope insertion station 18, postage station 20 and sorting station 22) form no part of the present invention input system 118, further discussion of each of these stations is also not described in detail in order not to obscure the present invention. Moreover, it is to be appreciated that the depicted embodiment of inserter system 10 implementing the present invention input system 100 is only to be understood as an example configuration of such an inserter system 10. It is of course to be understood that such an inserter system may have many other configurations in accordance with a specific user's needs.

Figure 2:
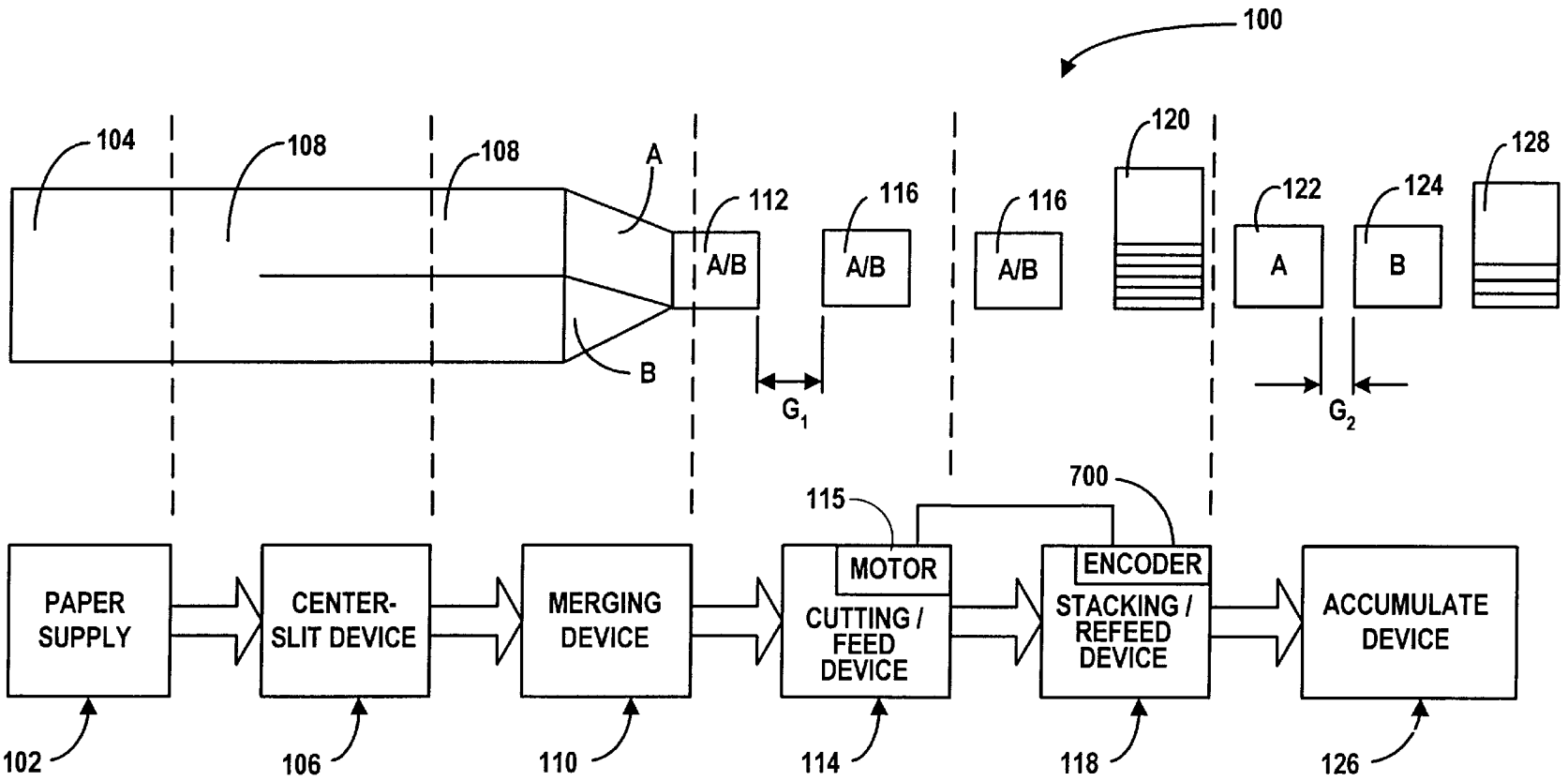
FIG. 2 is a block diagram schematic of the present invention input stations implemented in the inserter system of FIG. 1.

Referring now to FIG. 2 the input system 100 is shown. In the preferred embodiment, insert system 100 consists of a paper supply 102, a center-slitting device 106, a merging device 110, a cutting and feed device 114, a stacking and re-feed device 118 and an accumulating device 126. Regarding paper supply device 102, it is to be understood to encompass any known device for supplying side-by-side sheets from a paper web 104 to input system 100 (i.e., enabling a two-up format). Paper supply device 102 may feed the side-by-side web 104 from a web roll, which is well known in the art. Alternatively, paper supply device 102 may feed the side-by-side web 104 from a fan-fold format, also well known in the art. As is typical, web 104 is preferably provided with apertures (not shown) along its side margins for enabling feeding into paper supply station 102, which apertures are subsequently trimmed and discarded.

A center-slit device 106 is coupled to paper supply station 102 and provides a center slitting blade operative to center slit the web 104 into side-by-side uncut sheets 108 (A and B). Coupled to center-slit device 106 is a merging device 110 operative to transfer the center-slit web 108 into an upper-lower relationship, commonly referred to as a "two-up" format 112. That is, merging device 110 merges the two uncut streams of sheets A and B on top of one another, wherein as shown in FIG. 2, the left stream of uncut sheets A are positioned atop the right stream of sheets B producing a "two-up" (A/B) web 112. It is to be appreciated that even though the merging device 110 of FIG. 2 depicts the left side uncut sheets A being positioned atop the right side uncut sheets B (A/B), one skilled in the art could easily adapt merging device to position the right side uncut sheets B atop the left side A uncut sheets (B/A). An example of such a merging device for transforming an uncut web from a side-by-side relationship to an upper-lower relationship can be found in commonly assigned U.S. Pat. No. 5,104,104, which is hereby incorporated by reference in its entirety.

A cutting and feed device 114 is coupled to merging device 110 and is operative to cut the "two-up" A/B web 112 into separated "two-up" (A/B) individual sheets 116. Preferably, cutting and feed device 114 includes either a rotary or guillotine type cutting blade, which cuts the two sheets A and B atop one another 116 every cutter cycle. Preferably, the "two-up" (A/B) sheets 116 are fed from cutting and feed device 114 with a predetermined gap $G_1$ between each succession of "two-up" (A/B) collations 116 conveying downstream from cutting and feed device 114. It is to be appreciated that in order to maintain a high cycle speed for inserter system 10, the aforesaid "two-up" (A/B) web 112 is continually transported into cutting and feed device 114 at a constant velocity whenever possible. The feed device 114 further preferably includes a motor 115, preferably an AC frequency driven motor, which effects and controls the sheet cutting rate. The cutting mechanism within feed device 114 is preferably a DC servo motor that is electronically geared to feed motor 115.

A stacking and re-feed device 118 is coupled in proximity and downstream to cutting and feed device 114 and is operative to separate the "two-up" (A/B) sheet collations 116 into individual sheets 124 (A) and 126 (B). Stacking and re-feed device 118 is needed since the "two-up" (A/B) web 112 is merged before being cut into individual sheets and it is necessary to separate the two-up sheets 116 into individual sheets 122 (A) and 124 (B) prior to further downstream processing in inserter system 10. In the present preferred embodiment, the two-up sheets 116 (A and B) are separated from one another by stacking the aforesaid "two-up" (A/B) sheet collations 116 atop of one another in a stacking pile 120. Stacking and re-feed device 118 is configured to individually (e.g., in seriatim) feed one-up sheets 122, 124 (A, B) from sheet stack 120. Sheet and re-feed device 118 is further configured to individually re-feed the sheets from the bottom of stack 120 with a predetermined gap $G_2$ between each successive sheet 122 (A) and 124 (B). This gap $G_2$ may be varied by stacking and re-feed device 118 under instruction from control system 15, which gap $G_2$ provides breakpoints for enabling proper accumulation in downstream accumulating device 126. The rate at which sheets are withdrawn from the sheet stack 120 by re-feed device 118 may determined by simply be counting the number of sheets that are fed, or by counting the number of times that the re-feed device 118 is cycled, during a counting period.

As will be described further below, the stacking and re-feed device 118 preferably includes an encoder assembly 700 operative to monitor and determine the document stack height in the stacking and re-feed device 118. In dependence upon the determined document stack height, the encoder assembly 700 provides feedback to the motor 115 of the cutting and re-feed device 114 so as to control the supply rate for two-up sheets 116 being provided to the stacking and re-feed device 118 from the cutting and 11 feed device 114. Motor 115 also receives feedback regarding the rate at which one-up sheets 122 and 124 are being withdrawn from the bottom of the stack 120 by re-feed device 118 to further adjust the rate at which two-up sheets 116 are supplied.

It is pointed out that another advantage afforded by stacking and re-feed device 118 is that it enables inserter system 10 to maintain a high cycle speed. That is, in order for inserter system 10 to maintain a high cycle speed (e.g., approximately 18,000 mailpieces per hour) it is essential for the input of inserter system 100 to have a considerably greater cycle speed (e.g., approximately 72,000 sheets per hour) due to resulting time requirements needed for subsequent downstream processing (e.g., collating, accumulating, folding, etc). Furthermore, stacking and re-feed device 118 enables sheets to be fed in the aforesaid two-up format 116 from a web roll at an approximately constant speed (e.g., 36,000 cuts per hour) which is also advantageous in that it is difficult to control to the rotational speed of a large web roll (especially at high speeds) for feeding sheets therefrom due to the large inertia forces present upon the web roll. The individual sheets 122, 124 (A, B) are then individually fed from stack 120 at a second speed (e.g., over 250 inches per second), which second speed is greater than the input speed (e.g., approximately 117 inches per second). Because of this variation between the input speed and the output speed, it is necessary to adjust the input speed so that a stack of a desirable height can be maintained in the stacking and re-feed device 118. As a result the stack serves as a buffer from which individual sheets 122 and 124 can be drawn at varying speeds as needed, while the input speed can be adjusted to reestablish a desired stack height.

Coupled downstream to the stacking and re-feed device 118 is an accumulating device 126 for assembling a plurality of individual sheets of paper into a particular desired collation packet prior to further downstream processing. In particular, accumulating device 126 is configured to receive the seriatim fed individual sheets 122 and 124 from stacking and re-feed device 118, and pursuant to instructions by control system 15, collates a predetermined number of sheets 128 before advancing that collation downstream in inserter system 10 for further processing (e.g., folding). Accumulator device 126 may collate the sheets into the desired packets either in the same or reverse order the sheets are fed thereinto. Each collation packet 128 may then be folded, stitched or subsequently combined with other output from document feedings devices located downstream thereof and ultimately inserted into a envelope. It is to be appreciated that such accumulating devices are well known in the art, an example of which is commonly assigned U.S. Pat. No. 5,083,769 hereby incorporated by reference in its entirety.

Therefore, an advantage of the present invention mass mailing input system 100 is that it: 1) center slits a web before cutting the web 108 into individual sheets 116; 2) feeds individual sheets 116 at a high speed in a two-up format to a stacking pile 120; 3) feeds individual sheets 122, 124 (A, B) in seriatim in a one-up format from the stacking pile 120 for subsequent processing in the high speed inserter system 10; and 4) maintains an optimal buffer in the stacking and re-feed device by adjusting the input based on the optimal height and the rate of withdrawal. As mentioned above, this system arrangement is particularly advantageous in high-speed inserter systems where it is imperative to provide input sheets at high cycle speeds. In particular, the present invention input system 100 is advantageous in that it eliminates the need for a merging device downstream of the cutting device that results in an additional operation and time. Furthermore, the stacking of individual sheets in stacking and re-feed device 118 acts as a buffer between the accumulating device 126 and the paper supply 102 and provides quick response times to a feed and gap request from the control system 15 while enabling the paper supply 102 to provide a substantially constant feed of documents.

Figure 3:
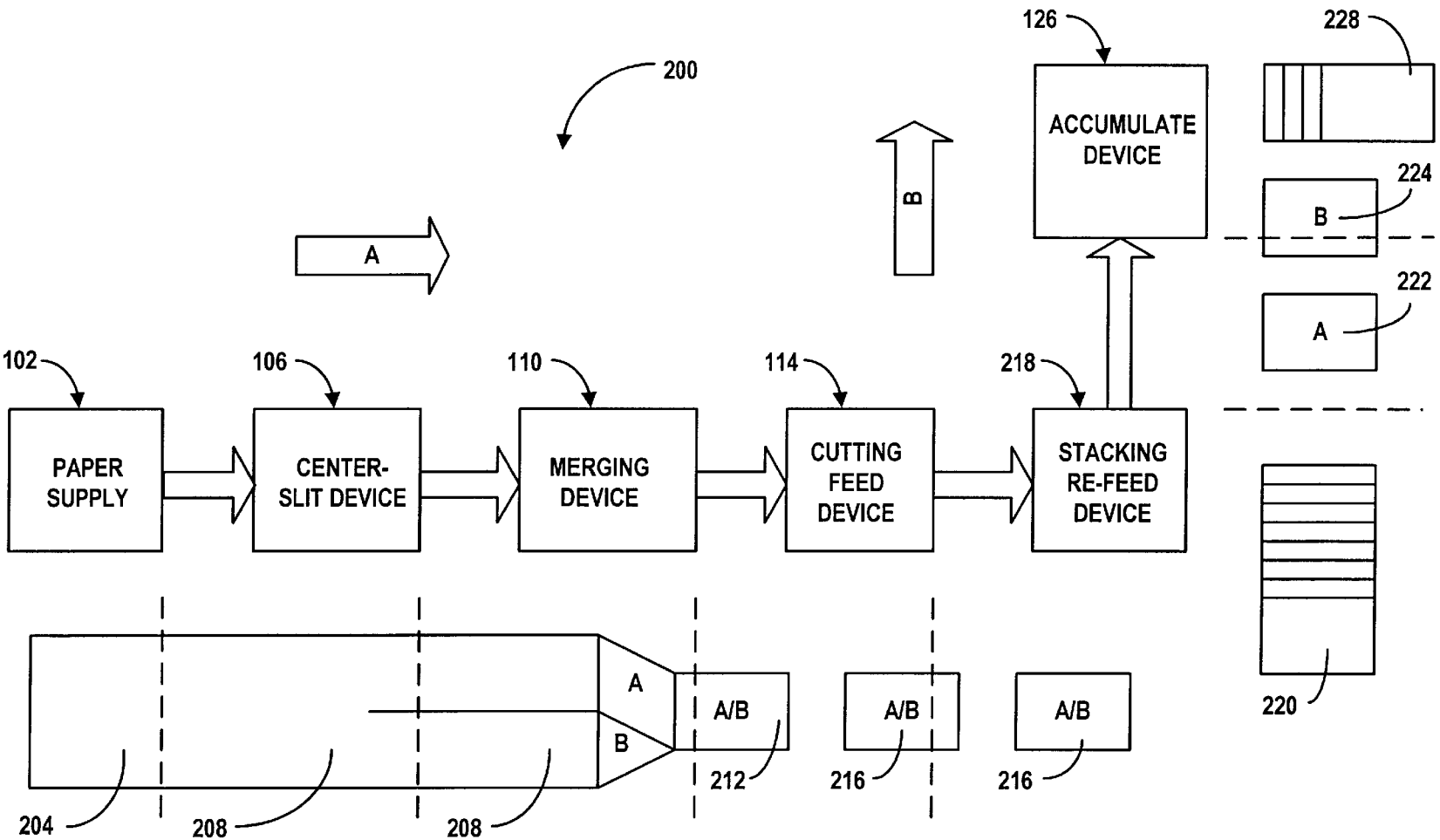
FIG. 3 is a block diagram schematic of another embodiment of the present invention input system.

Referring now to FIG. 3, there is shown an input system designated generally by reference numeral 200 that is substantial similar to the above described input system 100, wherein like reference numerals identify like objects. The difference being that stacking and re-feed device 218 of input system 200 is also configured as a "right-angle-turner." That is, stacking and re-feed device 218 changes the direction of travel for sheets 216 feeding from cutting device 114 by 90° relative to sheets 222 feeding from stacking and re-feed device 218.

In operation, and as depicted in FIG. 3, two-up sheets 216 are fed from cutting device 114 into stacking device 218 along a first direction of travel (represented by arrow "A"). As previously mentioned with regard to the stacking device 118 of input system 100, stacking device 218 stacks atop one another the two-up sheets 216 in a sheet pile 220. However, unlike the stacking device 118 of input system 100, stacking device 218 individually feeds, in seriatim, one-up sheets 222 and 224 along a second direction of travel (represented by arrow "B") oriented 90° relative to the aforesaid first direction of travel (represented by arrow "A").

An advantage of this arrangement is that sheets 216 can be fed from a paper supply 102 in a landscape orientation, whereby stacking device 218 changes the sheet orientation to a portrait orientation when sheets 222 are fed downstream from stacking device 218. Of course it is to be appreciated that the input system depicted in FIG. 3 is not to be understood to be limited to changing a sheets orientation of travel from landscape to portrait, as input system 200 may be adapted by one skilled in the art to change a sheets orientation of travel from portrait to landscape. An additionally advantage of input system 200 is that it changes the overall footprint of an inserter system, which is often required so as to suit a customers designated area that is to accommodate the inserter system.

With the input system 10 of the present invention being described above, discussion will now turn towards a preferred embodiment for the stacking and re-feed device 118 (e.g., the "sheet feeder").

Figure 4:
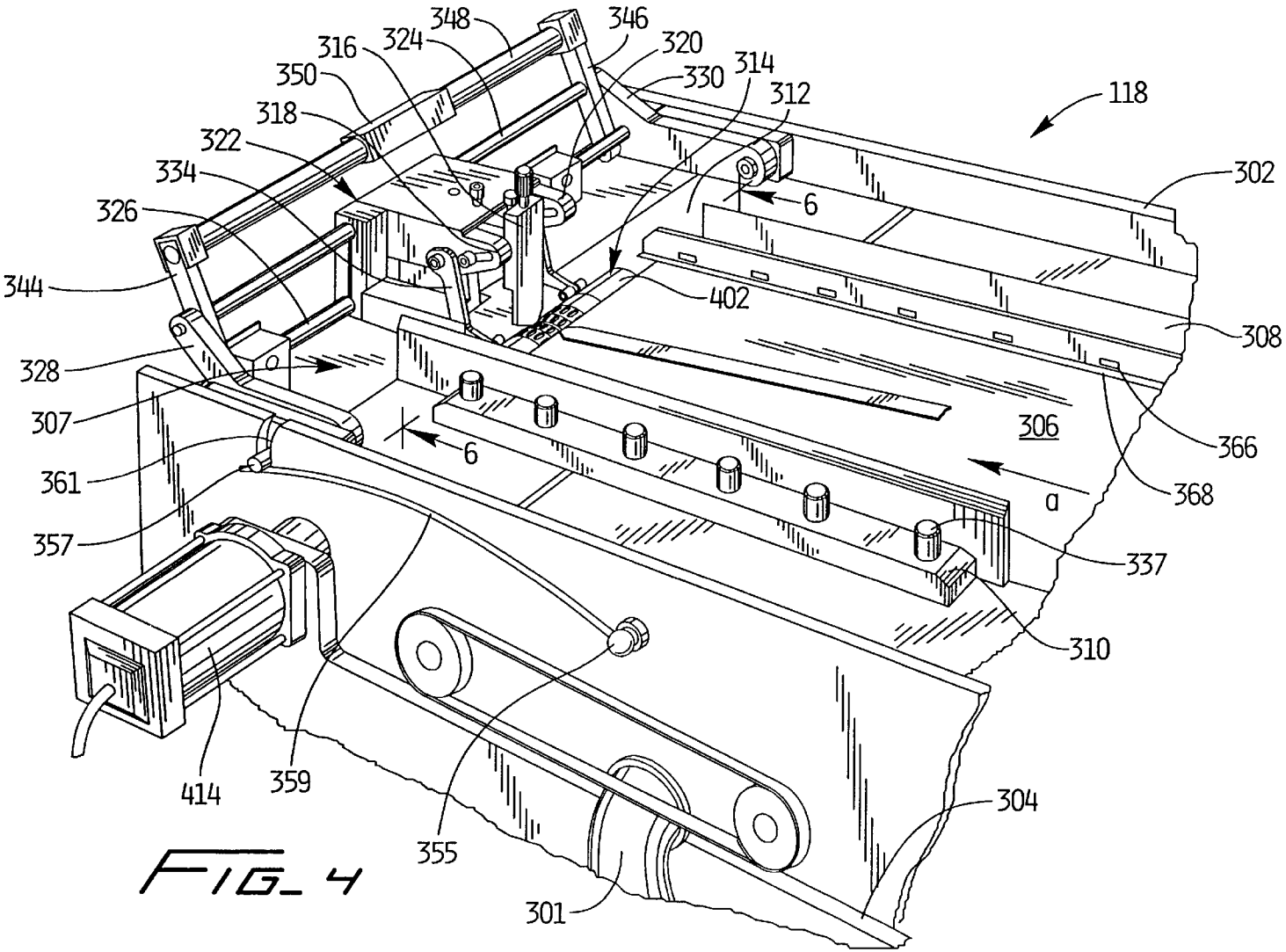
FIG. 4 is a perspective view of the upper portion of the present invention pneumatic sheet feeder.
Figure 7:
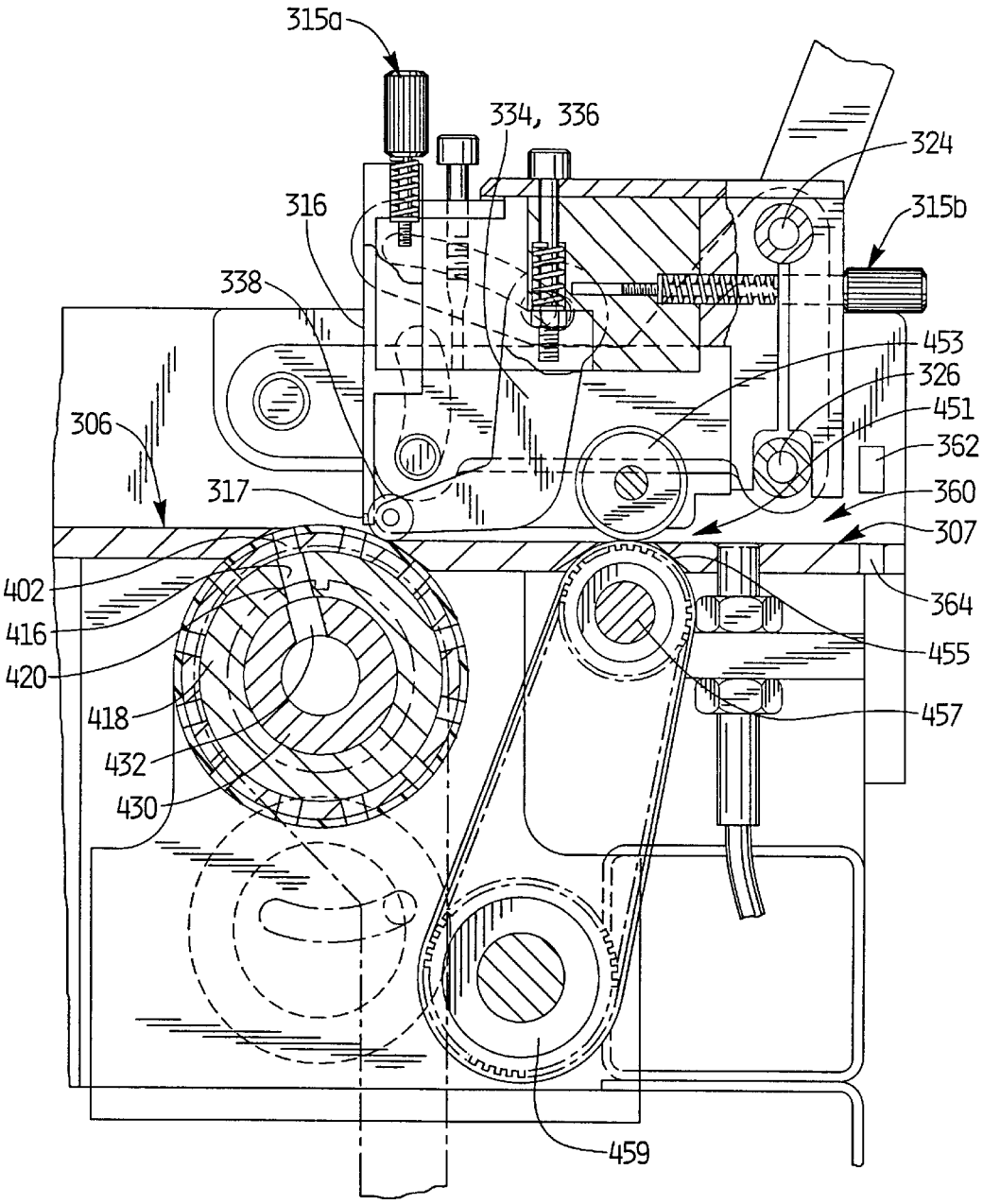
FIG. 7 is a cross-sectional view taken along line 7—7 of FIG. 6.

Referring now specifically to the sheet feeder 118 shown in FIG. 4, it includes a base frame having opposing side portions 302 and 304. A planar deck surface 306 is positioned and supported intermediate the base side portions 302 and 304. On the deck surface 306 are positioned two sheet guide rails 308, 310 that extend parallel to each other and are preferably displaceable transversely relative to each other by known means. An open slot 312 is formed on the deck 306 in which a pneumatic cylinder assembly 314 is mounted for rotation within and below a stripper plate 316 extending generally parallel with the cylinder assembly 314. The pneumatic cylinder assembly 314 includes an outer feed drum 402 that is mounted so that its top outer surface portion is substantially tangential to the top surface of the feed deck 306 and takeaway deck 307, which takeaway deck 307 is located downstream of the feed drum 402 (as best shown in FIG. 7). A more detailed description of the pneumatic cylinder assembly 314 and its operation will be provided further below.

With reference to FIG. 7, it can be seen that the outer circumference of the feed drum 402 extends between the open slot 312 formed between the angled ends of the two decks 306 and 307. The respective facing ends of the feed deck 306 and takeaway deck 307 are dimensioned (e.g., angled) so as to accommodate the outer circumference of the feed drum 402. The top portion of the outer circumference of the feed drum 402 extends above the top surfaces of both decks 306 and 307, wherein the top surface of the takeaway deck 307 resides in a plane slightly below the plane of the top surface of the feed deck 306. Preferably the takeaway deck 307 resides in a plane approximately one tenth of an inch (0.118") below the top planar surface of the feed deck 306. This difference in deck heights is chosen so as to minimize the angular distance the sheets have to travel around the feed drum 402 when feeding from the feed deck 306. By reducing this angular distance, the amount of "tail kick" associated with sheets being fed by the feed drum 402 is reduced. "Tail kick" can best be defined as the amount the trail edge of a sheet raises off the feed deck 306 as it leaves the feed drum 402. It is to be understood that "tail kick" is a function of sheet stiffness and the angle of takeaway as determined by the respective heights of the feed drum 402 and takeaway deck 307.

The stripper plate 316 is adjustably fixed between two mounting extensions 318, 320 extending from a mounting block 322. A first set screw 315*a* is received in a threaded opening in the top of the mounting block 322 for providing vertical adjustment of the stripper blade 316 relative to the deck 306 of the sheet feeder 118. A second set screw 315*b* is received in a threaded opening in the back of the mounting block 322 for providing lateral adjustment of the stripper blade 316 relative to the feed deck 306 of the sheet feeder 118.

As will be appreciated further below, the stripper blade 316 allows only one sheet to be fed at a time by creating a feed gap relative to the outer circumference of the feed drum 402, which feed gap is approximately equal to the thickness of a sheet to be fed from a sheet stack. In particular, the lower geometry of the stripper blade 316 is triangular wherein the lower triangular vertex 317 of the stripper blade 316 is approximately located at the center portion of the sheets disposed on the deck 306 as well as the center of the rotating feed drum 402. An advantage of the triangular configuration of the lower vertex 317 of the stripper blade 316 is that the linear decrease in the surface area of stripper blade 316 at its lower vertex 317 provides for reduced friction which in turn facilitates the feeding of sheets beneath the lower vertex 317 of the stripper blade 316. Preferably, it is at this region just beneath the lower vertex 317 of the stripper blade 316 in which resides a metal band 410 positioned around the outer circumference of the feed drum 402 (FIG. 5), (and preferably in the center portion of the feed drum 402) which metal band 410 acts as a reference surface for the position of the lower vertex of the stripper blade 316 to be set in regards to the feed drum 402. This is particularly advantageous because with the hard surface of the metal band 410 acts as a reference, a constant feed gap between the lower vertex 317 of the stripper blade 316 and the feed drum 402 is maintained.

Figure 5:
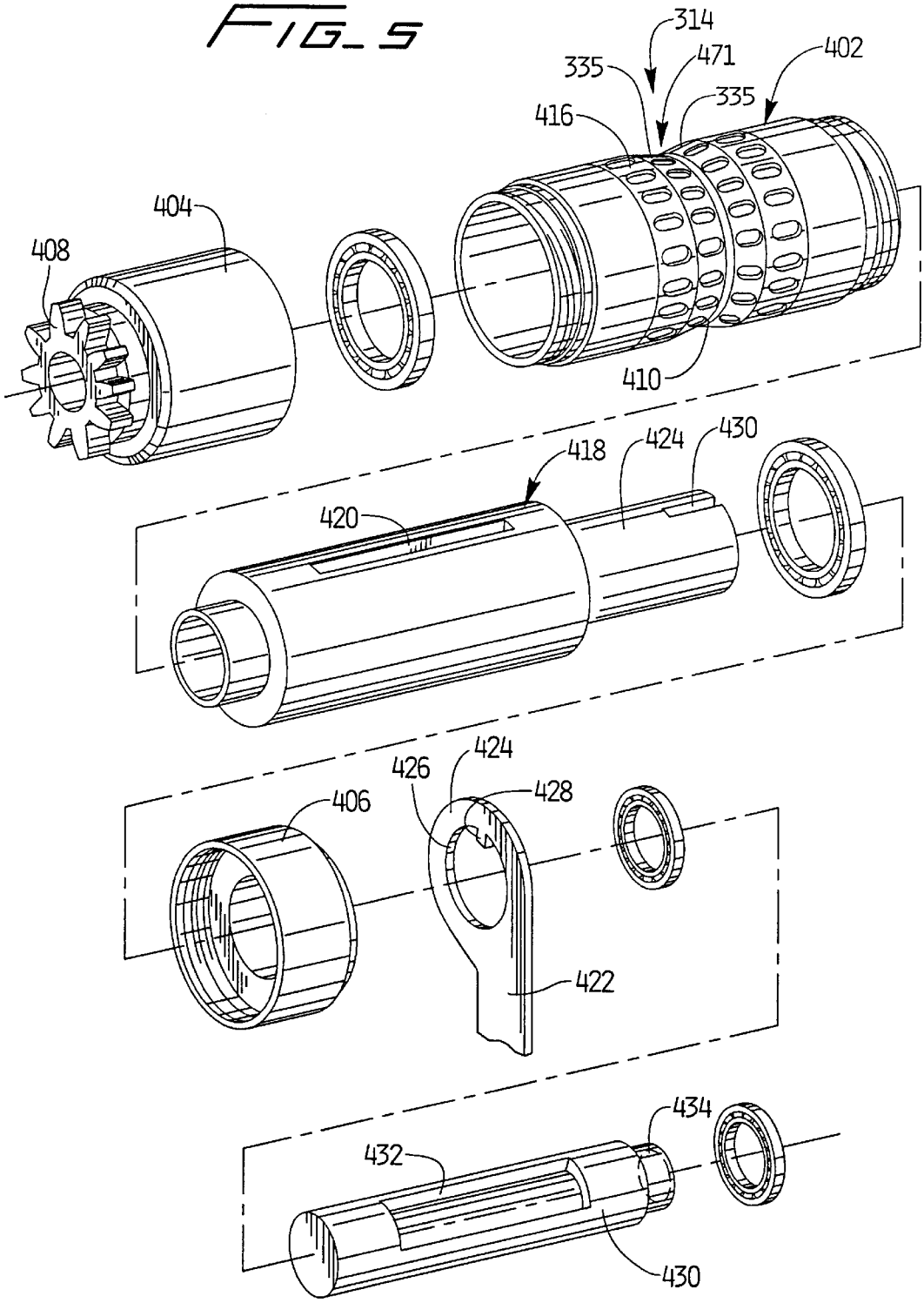
FIG. 5 is a perspective exploded view of the pneumatic cylinder assembly of the sheet feeder of FIG. 4.

With continuing reference to FIG. 5 the center portion of the feed drum 402 is provided with a recessed portion 471 preferably in a triangular configuration dimensioned to accommodate the lower triangular vertex 317 of the stripper blade 316.

Thus, the stripper blade 316 is positioned such that its lower triangular vertex 317 resides slightly above the recessed portion 471 of the feed drum 402 and is preferably separated therefrom at a distance substantially equal to the thickness of a sheet to be fed from a sheet stack residing on the feed deck 306 of the sheet feeder 118. As can also be seen in FIG. 4, the metal band 410 is preferably located in the lower vertex of the of the recessed portion 471 formed in the outer circumference of the feed drum 402. It is to be appreciated that an advantage of this formation of the recessed portion 471 in the feed drum 402 is that it facilitates the separation of the lower most sheets (by causing deformation in the center portion of a lowermost sheet) from the sheet stack 120 residing on the deck 306 of the sheet feeder 118.

Figure 10:
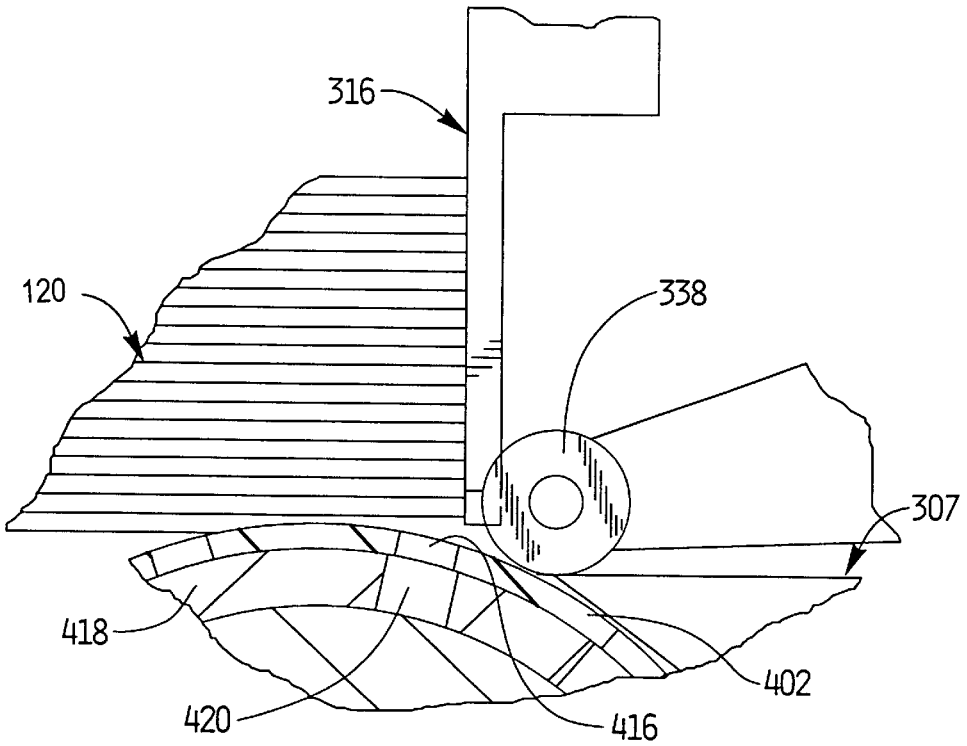
FIG. 10 is a partial enlarged view of FIG. 9.
Figure 11:
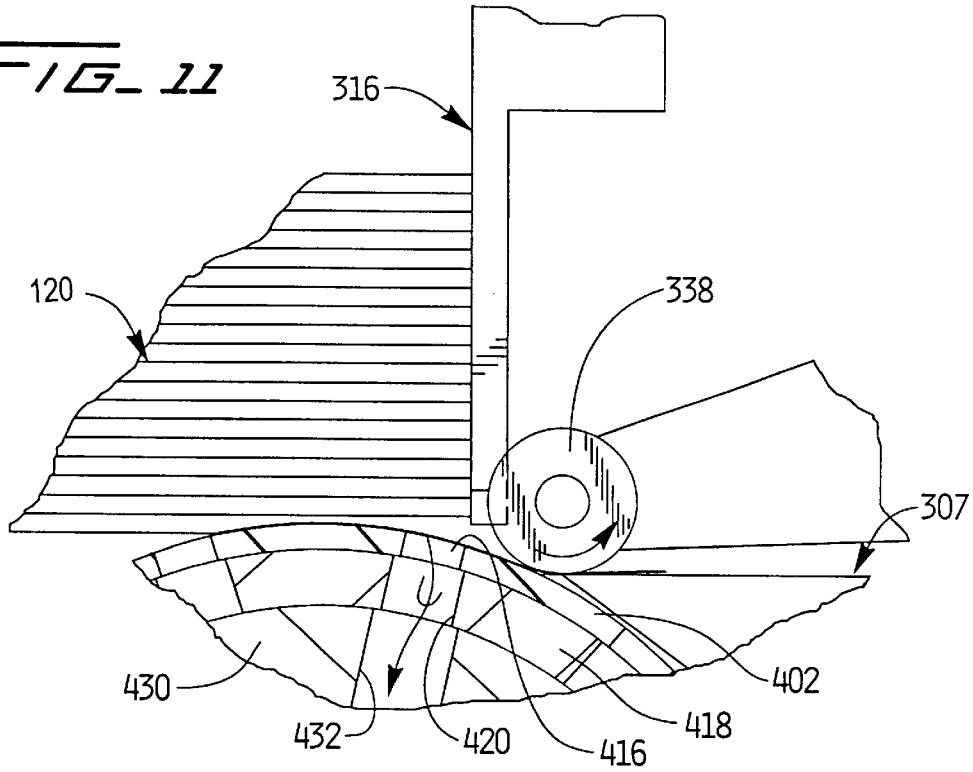
FIGS. 11 and 12 are partial enlarged views depicting a sheet feeding through the sheet feeder assembly of FIG. 4.

Also extending from the mounting block 322 are two drive nip arms 334, 336 each having one end affixed to the mounting block 322 while the other end of each opposing arm 334, 336 is rotatably connected to a respective "take-away" nip 338. Each takeaway nip 338 is preferably biased against the other circumference of the feed drum 402 at a position that is preferably downstream of the stripper blade 316 relative to the sheet flow direction as indicted by arrow "a" on the feed deck 306 of FIG. 4. It is to be appreciated that when sheets are being fed from the feed deck 306, each individual sheet is firmly held against the rotating feed drum 402 (as will be further discussed below). And when the sheets are removed from the feed drum 306, as best seen in FIGS. 10 and 11, the end portion of the takeaway deck 307 is provided with a plurality of projections or "stripper fingers" 333 that fit closely within corresponding radial grooves 335 formed around the outer circumference of the feed drum 402 so as to remove individual sheets from the vacuum of the feed drum 402 as the sheets are conveyed onto the takeaway deck 307. That is, when the leading edge of a sheet is caused to adhere downward onto the feed drum 402 (due to an applied vacuum, as discussed further below), the sheet is advanced by the rotation of the feed drum 402 from the feed deck 306 until the leading edge of the sheet rides over the stripper fingers 333. The stripper fingers 333 then remove (e.g., "peel") the sheet from the outer vacuum surface of the feed drum 402. Thereafter, immediately after each sheet passes over the stripper fingers 333 so as to cause that portion of the sheet conveying over the stripper fingers 333 to be removed from the vacuum force effected by outer surface of the feed drum 402, that portion of the sheet then next enters into the drive nip formed between the takeaway nips 338 and the outer surface of the feed drum 402, which nip provides drive to the sheet so as to ensure no loss of drive upon the sheets after its vacuum connection to the feed drum is terminated.

Regarding the takeaway nips 338, and as just stated, they collectively provide positive drive to each sheet that has advanced beyond the stripper fingers 333. It is noted that when sheets are advanced beyond the stripper fingers 333, the vacuum of the feed drum 402 is no longer effective for providing drive to those sheets. As such, the takeaway nips 338 are positioned slightly beyond the feed drum 402 and in close proximity to the downstream portion of the stripper fingers 333 as possible. It is noted that due to the limited space in the region near the stripper fingers 333 and the takeaway deck 307, it is thus advantageous for the takeaway nips 338 to have a small profile. Preferably, the takeaway nips 338 are radial bearings having a ⅜" diameter.

Figure 6:
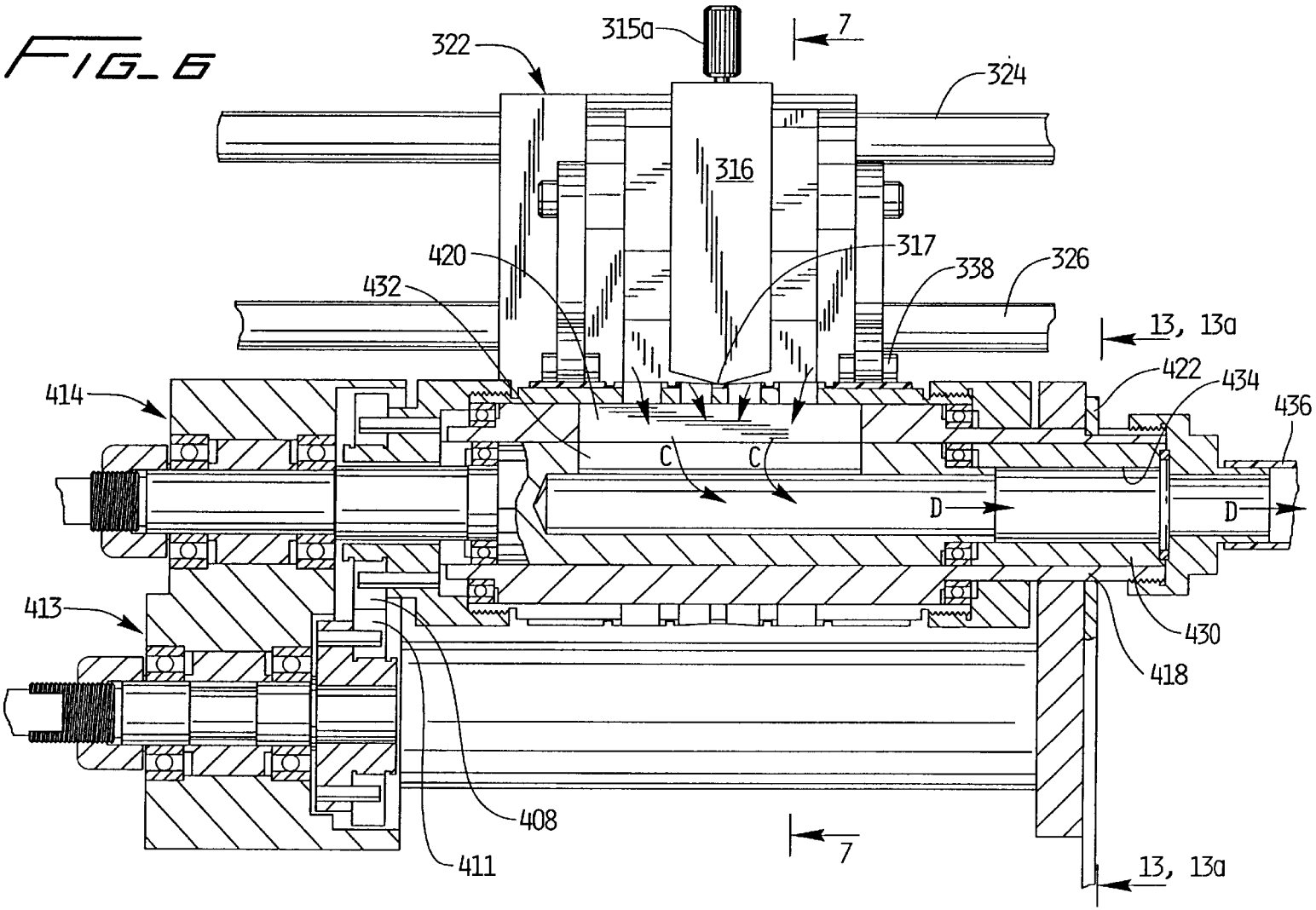
FIG. 6 is a cross-sectional view taken along line 6—6 of FIG. 4.

With reference to FIGS. 6 and 7, the mounting block 322 extends from upper and lower mounting shafts 324 and 326, wherein the lower shaft 326 extends through the mounting block 322 and has it opposing ends affixed respectively in pivoting arm members 328 and 330 (FIG. 4). Each pivoting arm member 328 and 330 has a respective end mounted to each side portion 302 and 304 of feeder 118 about a pivoting shaft 342. The other end of each pivoting arm member 328 and 330 has a respective swing arm 344, 346 pivotally connected thereto, wherein the pivot point of each swing arm 344, 346 is about the respective ends of upper shaft 324, which shaft 324 also extends through the mounting bock 322. A handle shaft 348 extends between the upper ends of the swing arms 344 and 346, wherein a handle member 350 is mounted on an intermediate portion of the handle shaft 348.

Figure 8:
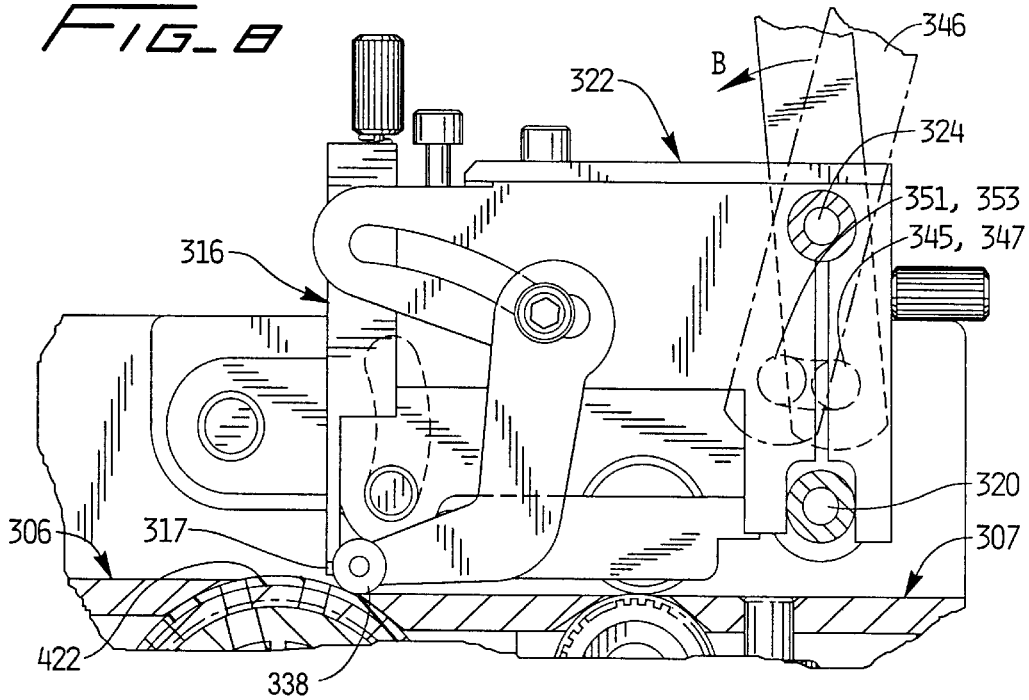
FIGS. 8 and 8*a* are partial side views of the sheet feeder of FIG. 4 depicting the mounting block in closed and open positions.
Figure 8A:
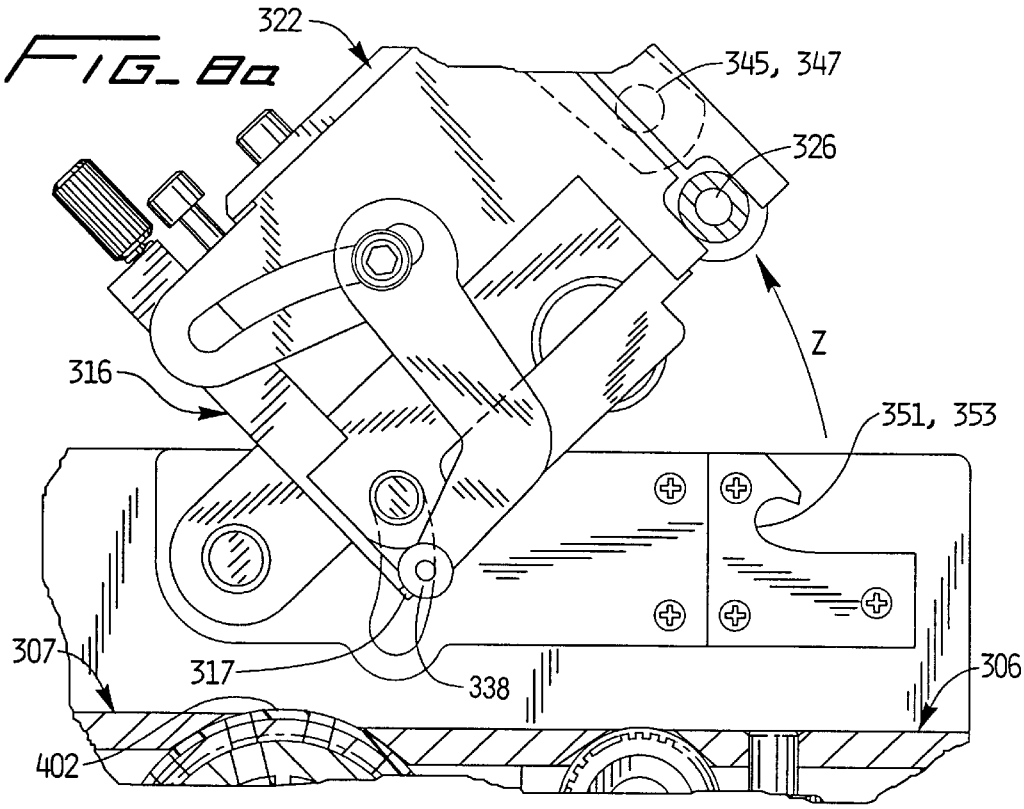

In order to facilitate the pivoting movement of the mounting block 322, and as is best shown if FIGS. 8 and 8*a*, the lower end portion of each swing arm 344, 346 is provided with a locking shaft 345, 347 that slideably extends through a grooved cutout portion (not shown) formed in the lower end portion of each pivoting arm member 328 and 330, wherein each locking shaft 345, 346 slideably receives in a grooved latch 251, 353 provided on each side 302, 304 of the sheet feeder 118 adjacent each pivoting arm member 328, 330. When each locking shaft 345, 347 is received in each respective grooved latch 351, 353 the mounting block 322 is positioned in a closed or locked positioned as shown in FIGS. 4 and 8. Conversely, when the locking shafts 345, 347 are caused to be pivoted out of their respective grooved latch 351, 353 (via pivoting movement of the two swing arms 344, 346), the mounting block 322 is caused to pivot upward and away from the deck 306 as is shown in FIG. 8*a*. As also shown in FIG. 8*a*, when the mounting block 322 is caused to be pivoted to its open position (FIG. 8*a*), the stripper blade 316 moves along a radial path (as indicated by arrow "z") so as not to intersect with the sheet stack 120 disposed on the deck 306 of the sheet feeder 118. This is particularly advantageous because when the mounting block 322 is caused to be moved to its open position (FIG. 8*a*), the sheet stack disposed on the feed deck need not be interrupted.

Providing an upward biasing force upon preferably one of the pivoting arm members 328, 330 (and in turn the mounting block 322) is an elongated spring bar 359 mounted on the outside surface of one of the side portions 304 of the sheet feeder 118.

In particular, one of the ends of the spring bar 359 is affixed to a mounting projection 355 extending from the side 304 of the sheet feeder 118 wherein the other end of the spring bar 359 is caused to upwardly bias against an end portion of a spring shaft 357 extending from one of the swing arms 328 when the mounting block 322 is positioned in its closed position (FIG. 4) as mentioned above. The spring shaft 357 extends through a grooved cutout 361 formed in a side portion 304 of the sheet feeder 118 wherein the other end of the spring shaft 357 extends from one of the pivoting arm members 328. Thus, when the locking shafts 345, 347 are caused to be pivoted out of their respective grooved latch 351, 353 (via pivoting movement of the two swing arms 344, 346), the upwardly biasing force of the spring bar 359 causes the swing arms 328 to move upward, which in turn causes the mounting block 322 to pivot upward and away from the deck 306 as is shown in FIG. 8*a* due to the biasing force of the spring bar 359.

It is to be appreciated that the mounting block 322 pivots upward and away from the deck 306, and in particular the vacuum drum assembly 314 so as to provide access to the outer surface portion of the outer drum 338 for maintenance and jam access clearance purposes. With continuing reference to FIG. 4 and with reference to FIGS. 8 and 8*a*, this is effected by having the operator pivot the handle portion 350, about shaft 324, towards the deck 306 (in the direction of arrow "b" in FIG. 8*a*), which in turn causes the pivoting arm members 328 and 330 to pivot upward about respective shafts 342, which in turn causes corresponding upward pivoting movement of the mounting block 322 away from the deck 306 of the sheet feeder 118. Corresponding upward pivoting movement is effected on the mounting block 322 by pivoting arm members 328 and 330 due to that shafts 324 and 326 extend through the mounting block 322, wherein the ends are affixed in respective swing arms 344 and 346, which are respectively connected to pivoting arm members 328 and 330.

As shown in FIG. 7, downstream of the drive nips 338 is provided an electronic sensor switch 360 in the form of a light barrier having a light source 362 and a photodetector 364. The electronic sensor switch 360 is coupled to the inserter control system 15 (FIG. 1) and as will be discussed further below detects the presence of sheets being fed from the sheet feeder 118 so as to control its operation thereof in accordance with a "mail run job" as prescribed in the inserter control system 15. Electronic sensor switch 360 may also serves to measure the rate at which sheets are fed from sheet feeder 118. Also provided downstream of the dive nips 338 is preferably a double detect sensor (not shown) coupled to the control system 15 and being operative to detect for the presence of fed overlapped sheets for indicating an improper feed by the sheet feeder 118.

With continued reference to FIG. 7, sheet feeder 118 is provided with a positive drive nip assembly 451 located downstream of the takeaway nips 338 and preferably in-line with the center axis of the takeaway deck 307 (which corresponds to the center of the feed drum 402). The drive nip assembly 451 includes an idler roller 453 extending from the bottom portion of the mounting block 322 which provides a normal force against a continuously running drive belt 455 extending from a cutout provided in the takeaway deck 307. The drive belt 455 wraps around a first pulley 457 rotatably mounted below the takeaway deck 307 and a second pulley 459 mounted within the sheet feeder 118. The second pulley 459 is provided with a gear that intermeshes with a gear provided on motor 413 (FIG. 6) for providing drive to the drive belt 455. Preferably, and as will be further discussed below, motor 413 provides constant drive to the drive belt 455 wherein the drive nip 451 formed between the idler roller 453 and drive belt 455 on the surface of takeaway deck 307 rotates at a speed substantially equal to the rotational speed of the feed drum 402 (due to the feed drums 402 connection to motor 413). Thus, the drive nip assembly 451 is operational to provide positive drive to a sheet when it is downstream of the takeaway nips 338 at a speed equal, or preferably slightly greater (due to gearing), than the rotational speed of the feed drum 402.

With returning reference to FIG. 4, the side guide rails 308 and 310 are preferably spaced apart from one another at a distance approximately equal to the width of sheets to be fed from the deck 306 of the sheet feeder 118. Each side guide rail 308, 310 is provided with a plurality spaced apart air nozzles 366, each nozzle 366 preferably having its orifice positioned slightly above thin strips 368 extending along rails 308 and 310 on the top surface of the feed deck 306. The air nozzles 366 are arranged on the inside surfaces of the guide rails 308 and 310 facing each other of rails 308 and 310, which are provided with valves (not shown) that can be closed completely or partly through manually actuated knobs 337. It is to be understood that each rail 308 and 310 is connected to an air source (not shown), via hose 301, configured to provide blown air to each air nozzle 366.

Referring now to the pneumatic cylinder assembly 314, and with reference to FIGS. 4–7, the pneumatic cylinder assembly 314 includes the feed drum 402 having opposing end caps 404, 406. Each end cap 404, 406 is preferably threadingly engaged to the end portions of the feed drum 402 wherein the end of one of the end caps 404 is provided with a gear arrangement 408 for providing drive to the feed drum 402. Preferably the gear 408 of the end cap 404 inter-meshes with a gear 411 associated with an electric motor 413 mounted on the side 304 of the sheet feeder 118 for providing drive to the feed drum 402. Positioned between the end caps 404, 406 and the outer surface of the feed drum 402 is a metal band 410 wherein the outer surface of the metal band 410 is substantially planar with the outer surface, preferably in the recessed portion 471, of the feed drum 402, the functionality of which was described above in reference to the setting of the stripper plate 316 relative to the feed drum 402.

Regarding the feed drum 402, it is preferably provided with a plurality of radial aligned suction openings 416 arranged in rows. The outer surface of the feed drum 402 is preferably coated with a material suitable for gripping sheets of paper such as mearthane. The outer surface of the feed drum 402 is mounted in manner so as to be spaced from the lower vertex 317 of the stripper plate 316 by a thickness corresponding to the individual thickness of the sheets. Additionally it is to be appreciated, as will be further discussed below, when feeder 118 is in use, the feed drum 402 is continuously rotating in a clockwise direction relative to the stripper blade 316. Preferably, the feed drum 402 rotates at a speed sufficient to feed at least twenty (20) sheets a second from a sheet stack disposed on the deck 306 of feeder 118.

Slideably received within the feed drum 402 is a hollowed cylindrical vacuum drum vane 418. The vacuum drum vane 418 is fixedly mounted relative to the feed drum 402 and is provided with a elongate cutout 420 formed along its longitudinal axis.

The drum vane 418 is fixedly mounted such that its elongate cutout 420 faces the suction openings 416 provided on the feed drum 402 preferably at a region below the lower vertex 317 of the stripper blade 316 (FIG. 7) so as to draw air downward (as indicated by arrow "c" in FIGS. 11 and 12) through the suction openings 416 when a vacuum is applied to the elongate cutout 420 as discussed further below. The vacuum drum vane 418 is adjustably (e.g., rotatable) relative to the feed drum 402 whereby the elongate cutout 420 is positionable relative to the suction openings 416 of the feed drum 402. To facilitate the aforesaid adjustablity of the drum vane 418, and with reference also to FIGS. 13 and 13*a*, an elongate vane adjuster 422 having a circular opening 426 at one of its ends is received about the circular end 424 of the drum vane 418. A key 428 is formed within the circular end 426 of the elongate vane adjuster, which receives within a corresponding key slot 430 formed in the end 424 of the drum vane 418 so as to prevent movement of the drum vane 418 when the vane adjuster 422 is held stationary. The vane adjuster 422 also is provided with a protrusion 423 extending from its side portion, which protrusion 423 is received within a guide slot 425 formed in a side portion 302 of the sheet feeder 318 for facilitating controlled movement of the vane adjuster 422 so as to adjust the drum vane 418.

Figure 13:
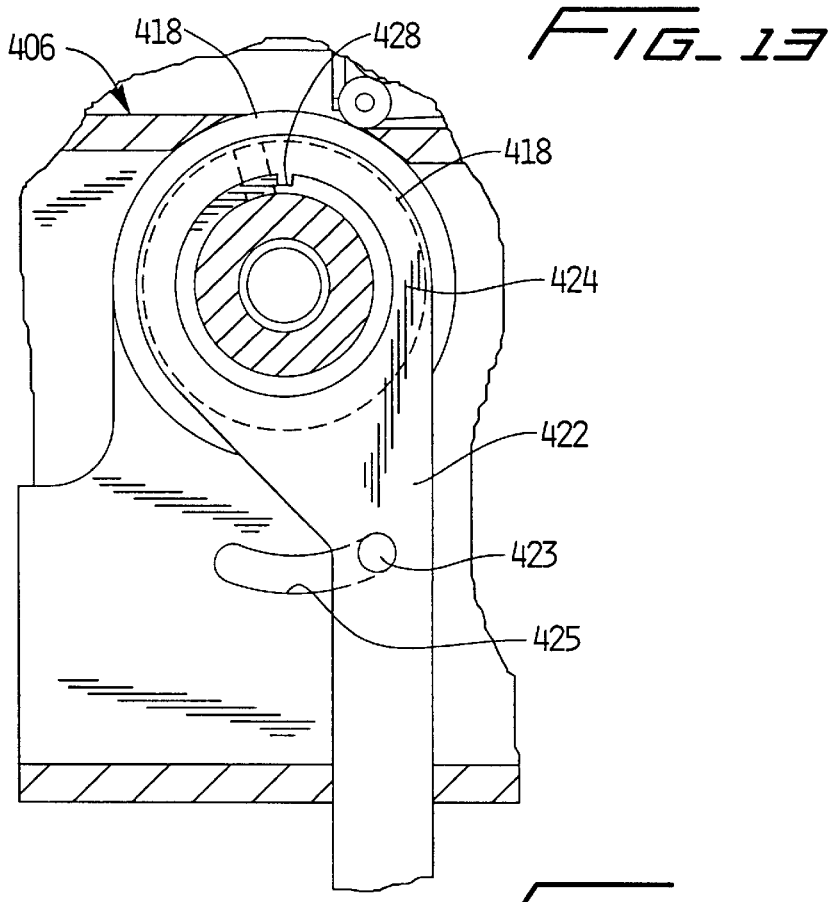
FIGS. 13 and 13*a* are partial enlarged sectional side views of the sheet feeder of FIG. 4 depicting the vane adjusting feature of the sheet feeder assembly.
Figure 13A:
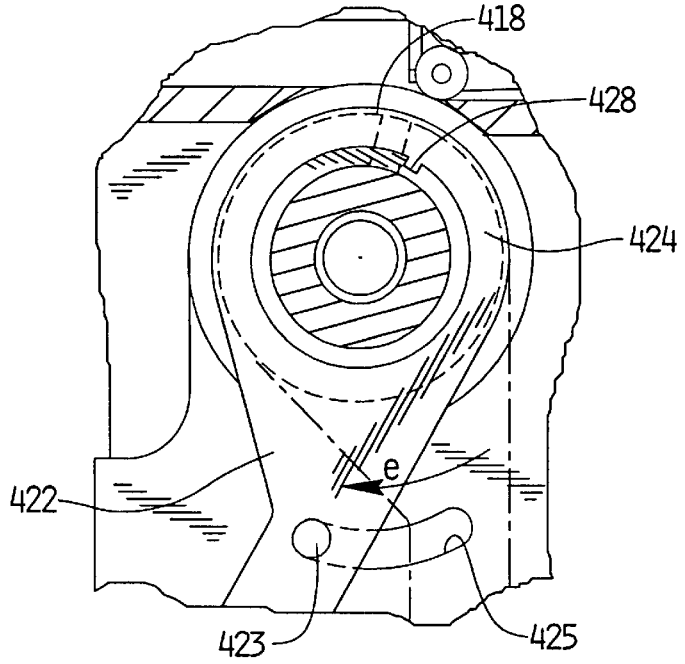

As best shown in FIGS. 13 and 13*a*, movement of the vane adjuster 422 affects corresponding rotational movement of the drum vane 418 so as to adjust the position of the elongate opening 420 relative to the suction openings 416 of the feed drum 402. Thus, when the vane adjuster 422 is caused to be moved along the direction of arrow "e" in FIG. 13*a*, the elongate opening 420 of the drum vane 418 rotates a corresponding distance. It is noted that when adjustment of the elongate cutout 420 of the drum vane 418 is not required, the vane adjuster 422 is held stationary in the sheet feeder 118 by any known locking means.

Slideably received within the fixed drum vane 418 is a hollowed valve drum 430, which is provided with an elongate cutout portion 432 along its outer surface. Valve drum 430 also has an open end 434. The valve drum 430 is mounted for rotation within the fixed drum vane 418, which controlled rotation is caused by its connection to an electric motor 414 mounted on a side portion 304 of the sheet feeder 118. Electric motor 414 is connected to the control system 15 of the inserter system 10, which control system 15 controls activation of the electric motor 414 in accordance with a "mail run job" as programmed in the control system 15 as will be further discussed below.

The open end 434 of the valve drum 430 is connected to an outside vacuum source (not shown), via vacuum hose 436, so as to draw air downward through the elongate opening 432 of the valve drum 430. It is to be appreciated that preferably a constant vacuum is being applied to the valve drum 430, via vacuum hose 436 (FIG. 6), such that when the valve drum 430 is rotated to have its elongate opening 432 in communication with the elongate opening 420 of the fixed drum vane 418 air is caused to be drawn downward through the suction openings 416 of the feed drum 402 and through the elongate openings 420, 432 of the fixed vane 418 and valve drum 430 (as indicated by arrows "c" in FIG. 6) and through the elongate opening 434 of the valve drum 430 (as indicated by arrows "d" in FIG. 6). As will be explained further below, this downward motion of air through the suction openings 416 facilitates the feeding of a sheet by the rotating feed drum 402 from the bottom of a stack of sheets disposed on the deck 306 of the feeder 118, which stack of sheets is disposed intermediate the two guide rails 308, 310. Of course when the valve drum 430 is caused to rotate such that its elongate cutout portion 432 breaks its communication with the elongate cutout 420 of the fixed vane 418, no air is caused to move downward through the suction openings 416 eventhough a constant vacuum is being applied to the valve drum 430.

With the structure of the sheet feeder 118 being discussed above, its method of operation will now be discussed. First, a stack of paper sheets 120 is disposed on the feed deck 306 intermediate the two guide rails 308, 310 such that the leading edges of the sheets forming the stack 120 apply against the stopping surface of the stripper plate 316 and that the spacing of the two guide rails 308, 310 from each other is adjusted to a distance corresponding, with a slight tolerance, to the width of the sheets. With compressed air being supplied to the spaced apart air nozzles 366 provided on each guide rail 308, 310, thin air cushions are formed between the lowermost sheets of the stack, through which the separation of the sheets from one another is facilitated and ensured.

Figure 9:
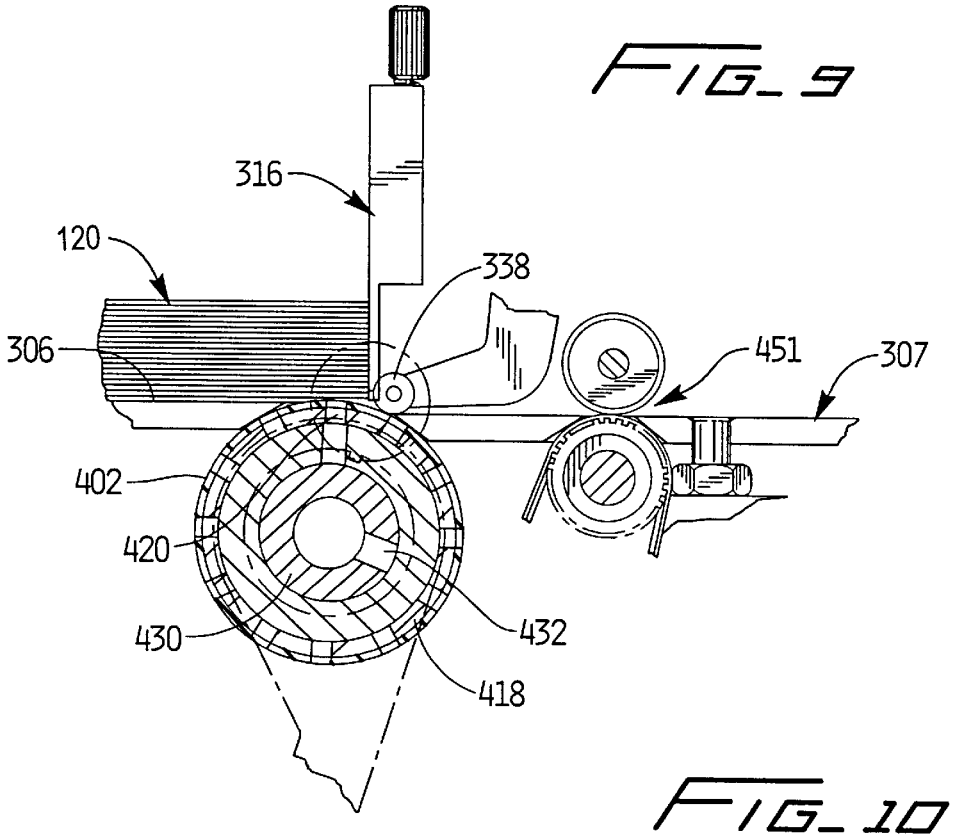
FIG. 9 is a partial side planar view, in partial cross-section, of the sheet feeder of FIG. 4 depicting the valve drum in its non-sheet feeding default position.

It is to be assumed that compressed air is constantly being supplied to the air nozzles 366 of the two guide rails 308, 310 and that the feed drum 402 and drive nip assembly 451 are constantly rotating, via motor 413, while a constant vacuum force is being applied to the valve drum 430, via vacuum hose 436. When in its default position, the valve drum 430 is maintained at a position such that its elongate cutout 432 is not in communication with the elongate cutout 420 of the drum vane 418 which is fixed relative to the constant rotating feed drum 402. Thus, as shown in FIGS. 9 and 10, no air is caused to flow downward through the cutout 420 of the drum vane 418, and in turn the suction openings 416 of the feed drum 402 eventhough a constant vacuum is applied within the valve drum 430. Therefore, eventhough the feed drum 402 is constantly rotating and the leading edges of the lowermost sheet of the stack 120 is biased against the feed drum 402, the feed drum 402 is unable to overcome the frictional forces placed upon the lowermost sheet by the stack 120 so as to advance this lowermost sheet from the stack 120. Therefore, when the valve drum 430 is positioned in its default position, no sheets are fed from the stack of sheets 120 disposed on the feed deck 306 of the sheet feeder 118.

Figure 12:
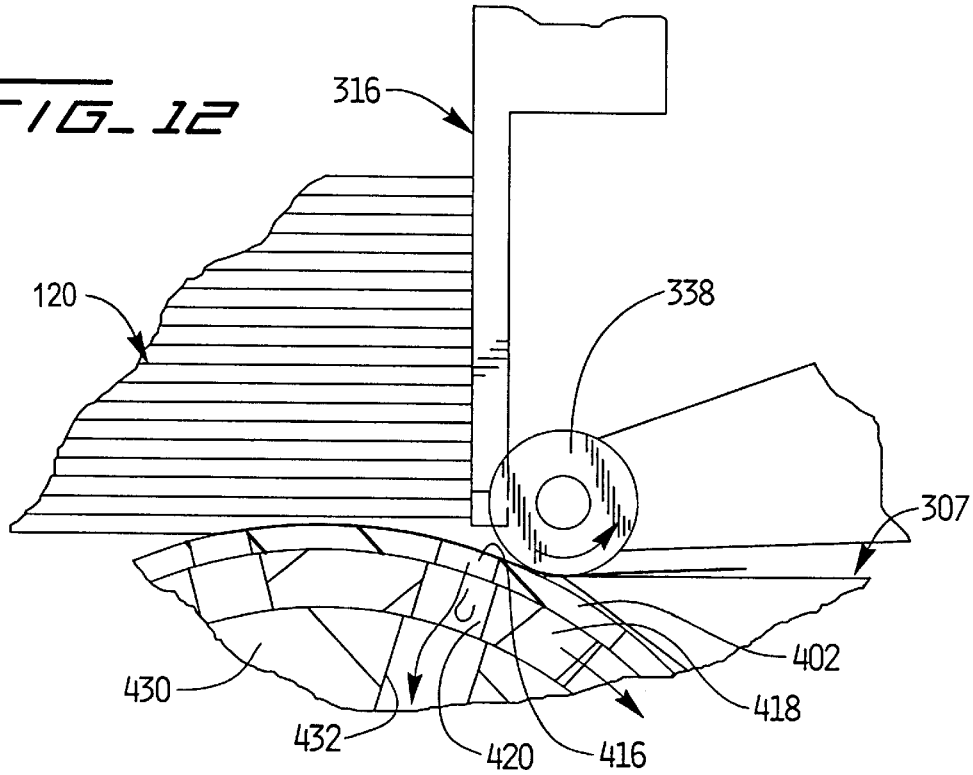

With reference to FIG. 11, when it is desired to feed individual sheets from the feed deck 306, the valve drum 430 is rotated, via motor 413, such that the elongate cutout 432 of the valve drum 430 is in communication with the elongate cutout 420 of the drum vane 418 such that air is instantly caused to be drawn downward through the suction openings 416 on the rotating feed drum 402 and through the respective elongate cutouts 420, 432 provided on the fixed drum vane 418 and the valve drum 430. This downward motion of air on the surface of the rotating feed drum 402, beneath the lower vertex 317 of the stripper plate 316, creates a suction force which draws downward the leading edge of the lowermost sheet onto the feed drum 402. This leading edge adheres against the rotating feed drum 402 and is caused to separate and advance from the sheet stack 120, which leading edge is then caused to enter into the takeaway nips 338 (FIG. 12) and then into the positive drive nip assembly 451 such that the individual sheet is conveyed downstream from the sheet feeder 318. Thus, when the valve drum 430 is rotated to its actuated position (FIGS. 11 and 12) the lowermost sheet of the stack 120 is caused to adhere onto the rotating feed drum 402, convey underneath the lower vertex 317 of the stripper plate 316, into the takeaway nips 438 and then positive drive nip assembly 451, and past the sensor 360, so as to be individual feed from the sheet feeder 118 and preferably into a coupled downstream device, such as an accumulator and/or folder 12. And as soon as the valve drum 430 is caused to be rotated to its default position (FIGS. 9 and 10), the feeding of sheets from the stack 120 is immediately ceased until once again the valve drum 430 is caused to be rotated to its actuated position (FIGS. 11 and 12).

It is to be appreciated that it is preferably the interaction between the sensor switch 360 with the control system 15 that enables the control of the sheet feeder 118. That is, when motor 414 is caused to be energized so as to rotate the valve drum 430 to its actuated position to facilitate the feeding of sheets, as mentioned above. Since the "mail run job" of the control system 15 knows the sheet collation number of every mailpiece to be processed by the inserter system 10, it is thus enabled to control the sheet feeder 118 to feed precisely the number of individual sheets for each collation corresponding to each mailpiece to be processed. Control system 15 also calculates the speed at which sheets are fed from sheet feeder 118 in order to provide feedback to adjust the input to the stacker/feeder 118.

For example, if each mailpiece is to consist of a two page collation count, the motor 414 is then caused to be energized, via control system 15, so as to rotate the valve drum to its actuated position (FIG. 11) for an amount of time to cause the feeding of two sheets from the sheet feeder 118, afterwhich the motor 414 is actuated again, via control system 15, so as to rotate the valve drum 430 to its default position (FIGS. 9 and 10) preventing the feeding of sheets. As stated above, the sensor switch 360 detects when sheets are fed from the sheet feeder 118, which detection is transmitted to the control system 15 to facilitate its control of the sheet feeder 118.

Of course the sheet collation number for each mailpiece can vary whereby a first mailpiece may consist of a two page collation while a succeeding mailpiece may consist of a four page collation. In such an instance, the control system 15 causes the valve drum 430 to be maintained in its actuated position (FIG. 11) for an amount of time to enable the feeding of two sheets immediately afterwards the control system 15 then causes the valve drum 430 to be maintained in its default position (FIGS. 9 and 10) for a predefined amount of time. After expiration of this predefined amount, the control system 15 causes to valve drum 430 to be again maintained in its actuated position for an amount of time to enable the feeding of four sheets, afterwhich the above process is repeated with respect to each succeeding sheet collation number for each succeeding mailpiece to be processed in the inserter system 10.

Figure 14:
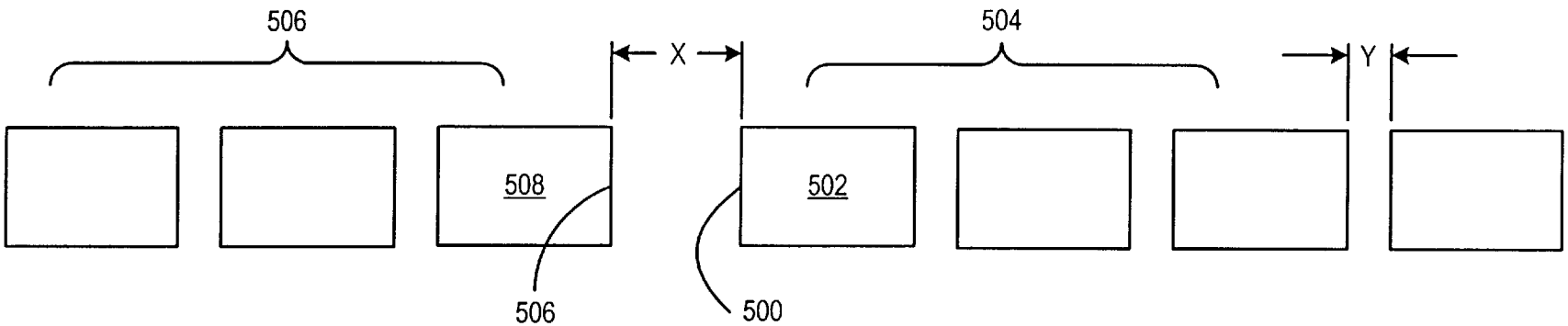
FIG. 14 is a sheet flow diagram illustrating the collation spacing provided by the sheet feeder of FIG. 4.

With reference to FIG. 14, it is noted that when the valve drum 430 is caused to be rotated and maintained in its default position (FIGS. 9 and 10), a predefined space (as indicated by arrow "x") is caused to be present between the trailing edge 500 of the last sheet 502 of a proceeding collation 504 and the lead edge 506 of the first sheet 508 of a succeeding collation 510. It is also noted that there is a predefined space (as indicated by arrow "y") between the trailing and leading edges of the sheets comprising each collation. It is to be appreciated that after the sheets are fed from the sheet feeder 118, they are then preferably conveyed to a downstream module for processing. An example of which is an accumulating station for accumulating the sheets collation so as to register their edges to enable further processing thereof, such as folding in a folding module 12. Therefore, the spacing between the trailing edge 500 of the last sheet 502 of a proceeding collation 504 and the lead edge 506 of the first sheet 508 of a succeeding collation 510 (as indicated by arrow "x") facilitates the operation of downstream module, such as an accumulating module (not shown), by providing it with sufficient time to enable the collection and processing of each collation of sheets fed from the sheet feeder 118 in seriatim.

With the overall operation of the input system 100 being described above a more particular method for controlling its operation will now be described. In particular, the interoperability of the cutting device 114 with the stacking and re-feed device 118 will now be described.

As stated above, and with reference to FIG. 2, it is the cutting device 114 that cuts the slit web 108 to provide two-up sheets 116 to the stacking and re-feed device 118. The stacking and re-feed device 118 in turn collects the two-up sheets 116 into a stack 120. The stacking and re-feed device 118 is operative, upon demand, to supply individual sheets 122 and 124 from the stack 120 to a downstream device, such as an accumulating device 126. It is to be appreciated that the demand for the stacking and re-feed device 118 to supply individual sheets is not linear. That is, the demand will vary in accordance with the mail pieces being assembled by the inserter system 10. For instance, some mail pieces may require a two page collation while others may require a four page collection. Thus the output supply of individual sheets from the stacking and re-feed device 118 will not be at a constant rate but rather will vary between periods of high and low demand. Therefore maintaining the stack of sheets 120 in the stacking and re-feed device 118 to include a optimal number of sheets is challenging since the supply rate to the stacking and re-feed device 118 must vary from the cutting device 114 in dependence upon the feed demand for the supply of individual sheets from the stack 120 of the stacking and re-feed device 118. Accordingly the rate of feeding from the stacking and re-feed device is monitored. Preferably, the rate is calculated as an average based on sheets fed during a cyclical monitoring period. While it is known that the addition of a buffering device (not shown) can alleviate some of the difficulties in maintaining a constant rate of operation for the input of an inserting system, it cannot ensure the constant rate of operation for the stacking and re-feed device 118.

Figure 15:
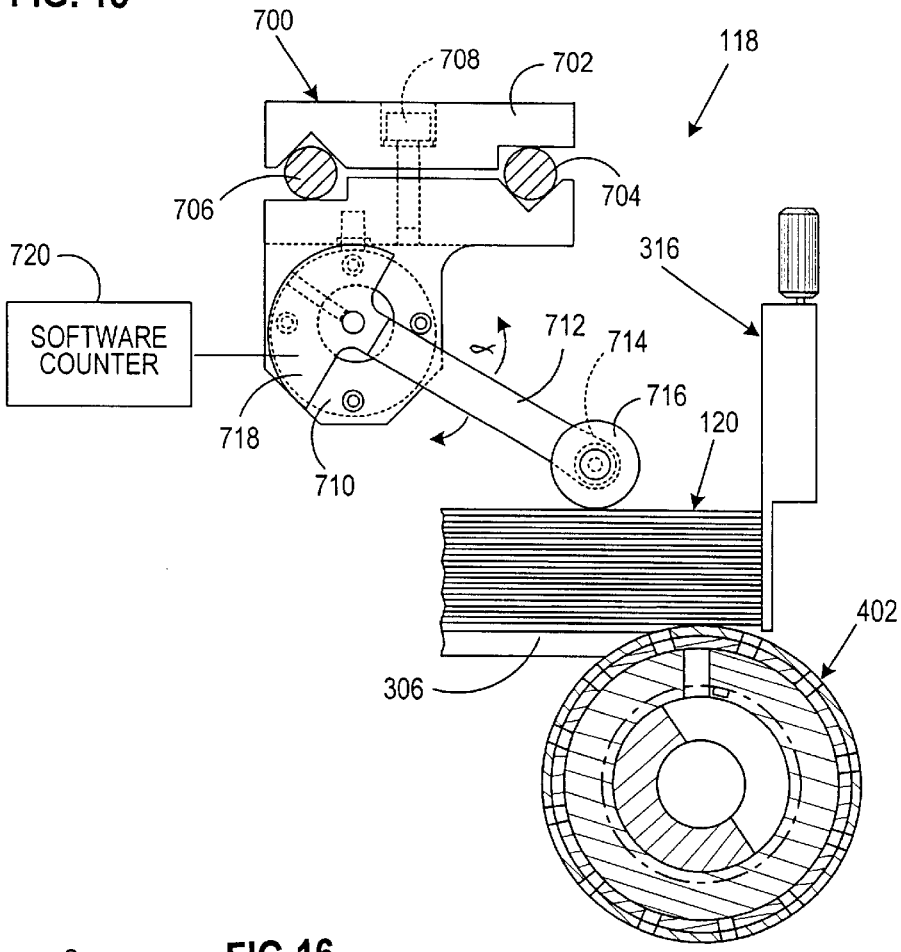
FIG. 15 is a partial side view of the sheet feeder of FIG. 4 depicting the inclusion of an encoder assembly for controlling the operation of the cutting device of FIG. 2.

With reference now to FIG. 15, the stacking and re-feed device 118 has been adapted to include an encoder assembly 700 that is operative to monitor the height of the document stack 120 disposed on the deck 306 of the stacking and re-feed device 118. As shown in FIG. 2, the encoder assembly 700 is operably coupled to the motor of cutting device 114. By monitoring the height of the document stack 120, the supply rate of sheets to the stacking and re-feed device 118 from the cutting device 114 can be adjusted via motor 115. Essentially, and as will be described in more detail below, when the height of the stack 120 reaches a maximum value, the rate of sheet delivery from the cutting device 114 is correspondingly reduced so as to prevent the height of the stack 120 from exceeding a predetermined maximum height. Conversely, when the height of the stack 120 begins to reach a minimum value, the rate of sheet delivery from the cutting device 114 is correspondingly increased so as to prevent the height of the stack 120 from reaching a predetermined minimum height. In other words, the encoder assembly 700 of the stacking and re-feed device 118 provides feedback to the motor 115 of cutting device 114 such that the rate of documents fed into the stacking and re-feed device 118 can be controlled to maintain the height of the stack 120 on the deck 306 of the stacking and re-feed device 118 within an optimal range.

The encoder assembly 700 preferably includes a housing 702 that is mounted above the deck 306 of the stacking and re-feed device 118 and intermediate the sidewalls 302 and 304 (FIG. 4) of the stacking and re-feed device 118. The housing 702 preferably suspends from a pair of parallel support rails 704 and 706 each extending between the sidewalls 302 and 304 of the stacking and re-feed device 118. The housing 702 is preferably formed by a two piece assembly which is secured to one another, about the support rails 704 and 706, by a mounting screw 708.

Mounted within a bottom portion of the housing 702 is a rotary encoder 710 having an elongated sensing arm 712 extending therefrom and projecting outwardly from the housing 702 such that the distal portion 714 of the sensing arm 712 is movably positioned in proximity to the stripper blade 316 of the stacking and re-feed device 118.

A sensing wheel 716 is rotatably mounted to the distal end 714 of the sensing arm 712 and resides on the top of the document stack 120 disposed on the deck 306 of the stacking and re-feed device 118. The sensing arm 712 pivots within an angular arc, as depicted by angle α in FIG. 15, which can be defined between the planar surface 306 of the stacking and re-feed device 118 to the top of a document stack 120 of a predetermined maximum height.

The sensing wheel 716 is preferably manufactured from Delrin AF due to its low friction and weight qualities. Additionally, the proximal end of the sensing arm 712 is preferably manufactured to include a counterbalance 718 whereby a minimum amount of downward force is applied to the document stack 120 by the sensing wheel 716 so as to decrease the likelihood of paper jams as individual sheets are caused to be fed from the stacking and re-feed device 118, via the outer drum 402. To further prevent such paper jams, the pivot point for the sensing arm 712 on the rotary encoder 710 is upstream from the rest position of the sensing wheel 716 on the document stack 120. The sensing arm 712 preferably positions the sensing wheel 716 in close proximity to the stripper blade 316 such that the documents of the stack 120 spend a minimal amount of time moving under the sensing wheel 716 enabling the sensing wheel 716 to operate with a wide range of differing paper sizes.

The rotary encoder 710 preferably has a resolution of approximately 2000 lines/rev, which resolution is determined by the angle of the sensing arm 712 as it sweeps between the planar deck surface 306 of the stacking and re-feed device 118 to the top of a document stack 120. Preferably, the maximum height for a document stack 120 is prescribed at 19 mm. Thus, the sensing arm 712 is to be understood to have a geometry of approximately 24 degrees of rotation, which translates into approximately 530 counts for the rotary encoder 710, or 530 discrete values over the full range of the document stack 120 maximum height. It is to be understood that this 24 degrees of rotation for the sensing arm 712 approximates to about 0.04 mm for each count of the rotary encoder 710, which is less than the thickness for the average piece of paper being fed from the stacking and re-feed device 118. It is to be further appreciated that since the sensing arm 712 travels though an arc, it's feedback is not linear with respect to the actual height of the document stack 120. However, this deviation is minimal and a linear approximation will suffice for operation of the encoder assembly 700.

The encoder assembly 700 further preferably includes a software counter 720, which will preferably be active whenever the stacking and re-feed device 118 is in operation. The software counter is programmed to reset to "0" on power-up of the stacking and re-feed device 118, provided that no documents reside in the planar surface 306 of the stacking and re-feed device 118. As documents feed into the stacking and re-feed device 118 forming a document stack 120, the sensing arm 712 will cause to pivot upward causing encoder rotation for the rotary encoder 710 which translates into positive software counts thus increasing the count in the software counter 720. Conversely, when the height of the document stack 120 is caused to decrease, the sensing arm 712 is caused to pivot downward causing negative counts which correspondingly decrease the count in the software counter 720. Thus, the count of the software counter 720 is indicative of the height of the stack 120 in the stacking and re-feed device 118.

In the preferred embodiment, the software counter 720 calculates the average stack height for an encoder averaging period by averaging actual stack height measurements over a predetermined interval of time in the order of microseconds. Accordingly, the stack height feedback information used for controlling the input speed to stacking and re-feed device 118 is based on incremental averaged measurements.

It is to be understood that the motor 115 of cutting device 114 that controls the cutting and supply speed for the cutting device 114 operates at a designated speed of "$S_c$" that ranges between 1 and 0 (where $S_c$=1 is maximum operating speed and $S_c$=0 is device stoppage). In the preferred embodiment, $S_c$ is updated periodically based on feedback information. The preferred update period for $S_c$ is the same as the encoder averaging period. The cutting and supply speed, $S_c$, for the cutting device 114 will range from 0–100% of 72,000 sheets (or 36,000 cuts) per hour for two up cutting, updated every encoder averaging period.

Further, the height of the document stack 120 is designated by "H"; and the nominal value for the height of the stack 120 is to be designated by $H_{nom}$ (e.g., 19 mm). The maximum permissible encoder deviation above nominal for stack height is designated as $H_{tol\text{-}hi}$. The minimum permissible encoder deviation below nominal for stack height is designated as $H_{tol\text{-}lo}$.

Another measurement important for implementing the present invention is the out-feed speed "$S_{of}$" that ranges from 1 to 0 (where $S_{of}$=1 is maximum operating speed and $S_{of}$=0 is device stoppage). $S_{of}$ is controlled as a function of control system 15 controlling the stacking and re-feeding device 118 in order to form accumulations in accordance with the control documents. $S_{of}$ is measured as an average speed over an out-feed averaging period and is converted to cuts per hour. Preferably $S_{of}$ is based on a five second moving average. Accordingly, the out-feed speed, $S_{of}$, will range from 0–100% of 72,000 sheets per hour based on the number of sheets fed.

As described above, the preferred method to monitor $S_{of}$ is to use optical sensor switch 360 to count sheets that are fed from stacker and re-feed device 118 during the out-feed averaging period. Alternatively, $S_{of}$ may be calculated based on information from control system 15 regarding the quantity of sheets included in the mail pieces that were known to have been processed during a particular period of time.

With the above designations set forth above, operation of the encoder assembly 700 will now be described. In operation, as documents are fed into the stacking and re-feed device 118 from the cutting device 114, the sensing arm 712 travels through an arc, causing the rotary encoder 710 to rotate through a given angle. Angular rotation of the rotary encoder 710 is translated into a number of counts or discrete values as dictated by software control, which count translates into the current height (H) of the document stack 120. For instance, as the stack height (H) increases, the operational speed ($S_c$) for the motor 115 of the cutting device 114 is decreased, thus decreasing its document feed rate to the stacking and re-feed device 118. Conversely, as the stack height decreases (H), the operational speed ($S_c$) for the motor 115 of the cutting device 114 is increased, thus increasing its document feed rate to the stacking and re-feed device 118. In essence, the cutting device 114 operates with a variable speed that is controlled by the height of the document stack 120 in the stacking and re-feed device 118, via encoder assembly 700. The following graph depicts the motor 115 speed ($S_c$)of the cutting device 114 against the height (H) of the document stack 120.

Concurrently with the foresaid adjustment based on current height (H), the adjustment of operational speed ($S_c$) will also be a function of the out-feed rate ($S_{of}$) of stacking and re-feed device 118 and any increase or decrease in operational speed ($S_c$) will be relative to the out-feed rate ($S_{of}$). For example, when the current stack height (H) is at the nominal height ($H_{nom}$), then the operational speed ($S_c$) of the cutting device 114 should be adjusted (or maintained the same) to stay in step with the out-feed rate ($S_{of}$) so the stack height will be driven back to the nominal height ($H_{nom}$). An increase or decrease in out-feed rate ($S_{of}$) will be reflected by a decrease or increase in stack height respectively, and the operational speed ($S_c$) will be adjusted relative to the out-feed rate ($S_c$), in order to drive the height (H) back to the nominal height ($H_{nom}$).

As a further example, for the situation where the stack height (H) is above the nominal height ($H_{nom}$), the operational speed ($S_c$) will be adjusted to be less than the out-feed rate ($S_{of}$). The corresponding adjustment to operational speed ($S_c$) is preferably calculated to be a fractional value of the out-feed rate ($S_{of}$). As a result of the input being less than the output, the stack height (H) will accordingly decrease and approach the nominal height ($H_{nom}$). In the preferred embodiment, the magnitude of the adjustment to operational speed ($S_c$) is a function of the magnitude of the deviation of the stack height (H) away from the nominal value. Thus, if the stack height (H) is far above its nominal value, the magnitude of the slow down to the input will be greater than if the stack height was only slightly above the nominal value. Thus as a higher than nominal stack height lowers towards nominal value, the magnitude of the adjustment to the operational speed ($S_c$) will correspondingly decrease. Conversely, if the stack height (H) starts to approach the maximum allowable height ($H_{tol_hi}$), the adjustment to the operational speed ($S_c$) will cause the input to slow towards stopping completely.

For the situation where the stack height (H) is below the nominal height ($H_{nom}$) similar principles apply, but with adjustments to input causing an increase in speed instead of a decrease. In the preferred embodiment, operational speed ($S_c$) is adjusted to be faster than the out-feed rate ($S_{of}$) by a fractional proportion of the remaining speed between $S_{of}$ and the maximum operating speed (100%). Thus, for example, if $S_{of}$ was operating at 60%, $S_c$ would be adjusted to be 60% plus some fraction of the remaining 40%. As the stack height decreases towards the minimum allowable height ($H_{tol_lo}$), then the fractional proportion of the remaining speed to be added will approach 100%. As described above, the magnitude of the speed increase adjustment is preferably a function of the magnitude of the deviation of the stack height (H) below the nominal height ($H_{nom}$). That is the lower the stack, the greater the increase for input speed relative to output speed.

For exemplary purposes, the following equations are provided to show a preferred embodiment for implementing the control scheme described above:

(1) For $H<(H_{nom}-H_{tol_lo})$, then $S_c=1$ $$\text{For } H_{nom} \geq H \geq (H_{nom} - H_{\text{tol_lo}}), \text{ then} \quad (2)$$

$$S_c = S_{of} + (1 - S_{of})\left(\frac{(H_{nom} - H)}{H_{\text{tol_lo}}}\right)$$

$$\text{For } H_{nom} \leq H \leq (H_{nom} + H_{\text{tol_hi}}), \text{ then} \quad (3)$$

$$S_c = S_{of}\left(1 - \frac{(H - H_{nom})}{H_{\text{tol_hi}}}\right)$$

(4) For $H>(H_{nom}+H_{tol_hi})$, then $S_c=0$

Figure 16:
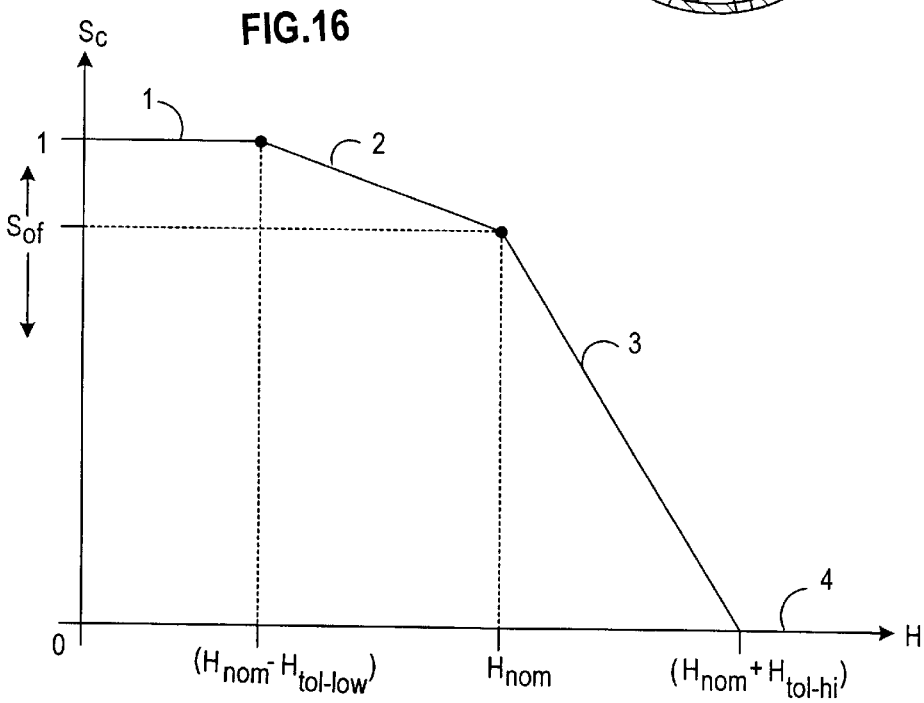
FIG. 16 is a graphical depiction of equations for controlling the operation of the cutting device of FIG. 2, or other input to the stacking and refeeding device.

These equations, (1)–(4) respectively, are depicted in graphical form in FIG. 16. The graph shown in FIG. 16, depicts adjusted input speed values calculated for a range of stack heights for a given value of $S_{of}$. However, as $S_{of}$ varies between 0 and 1, it will be understood that the solutions for $S_c$ will vary, and that a graphical representation such as that shown in FIG. 16 will look different for different values of $S_{of}$. Rather the segments will have different slopes depending on the value of $S_{of}$. The graph of FIG. 16 does not take into account the various boundary conditions discussed above.

Empirical study has also shown that certain boundary conditions are preferably implemented in conjunction with the above scheme for controlling the operational speed ($S_c$) of cutting device 114 in the system of the present invention. Some or all of these conditions may be implemented to avoid error conditions.

As a first boundary condition, any calculation of $S_c$ that results in a value greater than 1 (or 100%) should be rounded down to 1. Typically, the system should not be run faster than its maximum design speed, or malfunctions are likely to occur. Accordingly, this first boundary condition prevents speed adjustment that will either be unrecognizable to the controller, or that will likely result in a system malfunction.

As a second boundary condition, for calculations where SC is calculated to be less than 0.08 (8%), then cutting device 114 should stop completely to prevent malfunction of upstream devices at such low speeds. Additionally, where $S_c$ is less than 0.08 (8%) the cutting device 114 will remain stopped for a minimum of three seconds to allow the stack to sufficiently empty before continuing.

For a third boundary condition, if no out-feed rate exists during an out-feed averaging period, then $S_c$ shall be set to 0.5 (50%) and remain so until a valid out-feed rate ($S_{of}$) can be calculated. An example of a no out-feed rate condition is when downstream processing does not require any sheets to be fed during a particular averaging period. Another no-out feed condition may occur if the sheet stack becomes too low or empty. This boundary condition is necessary because in calculating $S_c$ as a function of $S_{of}$, an anomalous reading of no out-feed rate should not cause the input to halt, especially when such a condition may be a result of a situation where halting is undesirable.

The fourth boundary condition is similarly needed to address a potential problem resulting from calculating $S_c$ as a function of $S_{of}$. When stack height (H) gets very low, there is a danger that the stack will run out, and that no sheets will be available when needed. Thus, when the stack is low, it is desirable that the input feed rate $S_c$ not slow down, even if it is detected that the out-feed rate $S_{of}$ has slowed down. Accordingly, when it is detected that the stack height (H) goes below a predetermined level (for example $H_{tol_lo}$) then for the purpose of calculating an adjustment to the input rate $S_c$, as exemplified in the equations above, any decrease in the out-feed rate $S_{of}$ will not be recognized for the purposes of that calculation. In effect, when the stack height (H) is below that predetermined level, the value for $S_{of}$ for purposes of the adjustment calculation will remain frozen at a higher value, and only an increase in the out-feed rate $S_{of}$ will be recognized.

Thus in applying the speed adjustment scheme described above, the software counter 720 for the encoder assembly 700 and optical sensor switch 360 become the feedback for the AC frequency motor which drives the web cutting device 114. It is further to be appreciated that the speed changes for the motor 115 of the cutting device 114 occur independent of the state of the devices downstream of the stacking and re-feed device 118.

In summary, an input system 118 for providing individual documents to a high speed mass mailing inserter system 10 has been described. Although the present invention has been described with emphasis on particular embodiments, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A method for feeding sheets of paper to an inserter system, comprising the steps of:

supplying individual sheets at a controlled supply rate from a sheet supplying device;

receiving the individual sheets in a sheet stacking device from the sheet supplying device;

stacking the individual sheets in the stacking device;

feeding individual sheets from the sheet stack in the stacking device to another device in the inserter system coupled downstream to the sheet stacking device;

monitoring a variable out-feed rate at which individual sheets are fed from the sheet stack;

monitoring a height of the sheet stack;

comparing the height of the sheet stack to a predetermined nominal height;

if the height of the sheet stack is greater than the predetermined nominal height, adjusting the controlled supply rate to be less than the variable out-feed rate;

if the height of the sheet stack is less than the predetermined nominal height, adjusting the controlled supply rate to be greater than the variable out-feed rate;

comparing the height of the sheet stack to a predetermined maximum height;

comparing the height of the sheet stack to a predetermined minimum height;

if the height of the sheet stack is greater than the maximum height, adjusting the controlled supply rate to zero;

if the height of the sheet stack is less than the minimum height, adjusting the controlled supply rate to a maximum supply rate;

determining a height difference between the predetermined nominal height and the height of the sheet stack; and wherein a magnitude of adjustments to the controlled supply rate relative to the out-feed rate is a function of the height difference, the function defining a relationship whereby the greater the height difference, the greater the magnitude of the adjustment; and wherein the following definition apply: the controlled supply rate is $S_c$, the variable out-feed rate is $S_{of}$, the height of the sheet stack is H, the predetermined nominal height is $H_{nom}$, the predetermined maximum height above $H_{nom}$ is $H_{tol_hi}$, the predetermined minimum height below $H_{nom}$ is $H_{tol_lo}$, and the maximum supply rate is 1; and whereby the steps of adjusting the controlled supply rate include making adjustments in accordance with equations as follows:

$$S_c = S_{of}\left(1 - \frac{(H - H_{nom})}{H_{\text{tol_hi}}}\right)$$

$$S_c = S_{of} + (1 - S_{of})\left(\frac{(H_{nom} - H)}{H_{\text{tol_lo}}}\right).$$

2. The method of claim 1 further comprising the step of adjusting the controlled supply rate to match the variable out-feed rate, if the height of the sheet stack is the predetermined nominal height.

3. The method of claim 1 including the step of rounding the value of $S_c$ to 1 for any calculation in which $S_c$ is greater than 1.

4. The method of claim 1 wherein the steps of adjusting the controlled supply rate include stopping the controlled supply rate if the adjustments cause the controlled supply rate to go below a predetermined minimum operational supply rate.

5. The method of claim 4 wherein the step of stopping the controlled supply rate, if the adjustments cause the controlled supply rate to go below a predetermined minimum operational supply rate, is maintained for a minimum stop interval of time.

6. The method of claim 1 wherein, if the height of the sheets stack is below a predetermined low level, then the adjustments to the controlled supply rate do not decrease the controlled supply rate as a function of a decrease in the out-feed rate.

7. A method for feeding sheets as recited in claim 1 wherein the step of supplying individual sheets includes the step of providing separated sheets from a web supply.

8. A method for feeding sheets as recited in claim 7 wherein the step of supplying individual sheets further includes the step of bursting sheets from the web supply.

9. A method for feeding sheets as recited in claim 7 wherein the step of supplying individual sheets further includes the step of cutting sheets from the web supply.

10. A method for feeding sheets as recited in claim 7 wherein the step of supplying individual sheets further includes the step of supplying sheets from a supply of individual sheets disposed substantially adjacent one another on a sheet supply paper deck.

11. A method for feeding sheets as recited in claim 7 wherein the step of supplying individual sheets further includes the step of supplying individual sheets disposed substantially atop one another to the stacking device.

12. A method for feeding sheets as recited in claim 1 wherein the feeding step includes feeding the individual sheets to a sheet accumulating device for accumulating a predetermined number of sheets.

13. The method for feeding sheets as recited in claim 1 wherein the step of feeding further includes feeding from the sheet stack individual sheets wherein the individual sheets can be fed in groups comprising of one or more sheets whereby each sheet in a group is in seriatim with one another and each sheet is separated from one another by a first predetermined distance.

14. A method as recited in claim 13, wherein the feeding step further includes the step of separating each sheet group from one another by a second predetermined distance.

15. A method as recited in claim 13, wherein the feeding step includes the step of feeding each sheet with a rotating feed drum.

16. A method as recited in claim 15, wherein the rotating feed drum is constantly rotating.

17. A method as recited in claim 16, further including the step of drawing a vacuum in the feed drum for causing a sheet to adhere against the rotating feed drum.

18. A method as recited in claim 16, further including the step of rotating an inner valve cylinder rotatably disposed within the feed drum between an actuated position for causing a vacuum to be drawn in the feed drum such that a sheet adheres against the rotating feed drum and a default position for terminating the vacuum being drawn in the feed drum.

19. A method as recited in claim 18, further including the step of providing a constant vacuum source to the inner valve cylinder.

20. A method as recited in claim 13 further comprising the step:

accumulating a predetermined number of individual sheets in a sheet collation subsequent to feeding them from the sheet stack.

21. A method as recited in claim 13 wherein the merging step includes the step of center-slitting the paper web having the at least two web portions in side-by-side relationship.

22. The method of claim 1 wherein the step of monitoring the variable out-feed rate includes sensing feeding of sheets from the sheet stacking device with an optical sensor.

23. A sheet feeding apparatus for feeding sheets of paper to an inserter system, the apparatus comprising:

a sheet supply device for supplying individual sheets at a controlled supply rate;

a sheet stacking device receiving individual sheets from the sheet supplying device, the individual sheets forming a sheet stack in the stacking device;

a feeding device for feeding individual sheets from the sheet stack in the stacking device to another device in the inserter system coupled downstream of the sheet stacking device;

an out-feed sensor for detecting a variable out-feed rate at which individual sheets are fed from the sheet stack;

a stack height monitoring device for sensing a height of the sheet stack;

a processor coupled to the out-feed sensor and the stack height monitoring device, the processor programmed to control the controlled supply rate from the sheet supplying device, the processor further being programmed to compare the height of the sheet stack to a predetermined nominal height and adjusting the controlled supply rate as follows:

if the height of the sheet stack is greater than the predetermined nominal height, adjusting the controlled supply rate to be less than the variable out-feed rate;

if the height of the sheet stack is less than the predetermined nominal height, adjusting the controlled supply rate to be greater than the variable out-feed rate;

wherein the processor is further programmed to adjust the controlled supply rate to match the variable out-feed rate, if the height of the sheet stack is the predetermined nominal height;

compare the height of the sheet stack to a predetermined maximum height;

compare the height of the sheet stack to a predetermined minimum height;

if the height of the sheet stack is equal to or greater than the maximum height, adjust the controlled supply rate to zero;

if the height of the sheet stack is equal to or less than the minimum height, adjust the controlled supply rate to a maximum supply rate;

the processor is further programmed to determine a height difference between the predetermined nominal height and the height of the sheet stack; and wherein a magnitude of adjustments to the controlled supply rate relative to the out-feed rate is a function of the height difference, the function defining a relationship whereby the greater the height difference, the greater the magnitude of the adjustment; and wherein the following definitions apply; the controlled supply rate is $S_c$, the variable out-feed rate is $S_{of}$, the height of the sheet stack is H, the predetermined nominal height is $H_{nom}$, the predetermined maximum height above $H_{nom}$ is $H_{tol_{hi}}$, the predetermined minimum height below $H_{nom}$ is $H_{tol_{lo}}$, and the maximum supply rate is 1; and wherein the processor is further programmed to adjust the controlled supply rate include making adjustments in accordance with equations as follows:

$$S_c = S_{of}\left(1 - \frac{(H - H_{nom})}{H_{\text{tol_hi}}}\right)$$

$$S_c = S_{of} + (1 - S_{of})\left(\frac{(H_{nom} - H)}{H_{\text{tol_lo}}}\right).$$

24. The apparatus of claim 23 wherein the processor is further programmed to adjust the controlled supply rate to match the variable out-feed rate, if the height of the sheet stack is the predetermined nominal height.

25. The apparatus of claim 23 including the step of rounding the value of $S_c$ to 1 for any calculation in which $S_c$ is greater than 1.

26. The apparatus of claim 23 wherein the processor is further programmed to adjust the controlled supply rate by stopping the controlled supply rate if the adjustments cause the controlled supply rate to go below a predetermined minimum operational supply rate.

27. The apparatus of claim 26 wherein the processor is further programmed to maintain stoppage of the controlled supply rate for a minimum stop interval, if the adjustments cause the controlled supply rate to go below a predetermined minimum operational supply rate.

28. The apparatus of claim 23 wherein, if the height of the sheets stack is below a predetermined low level, the processor is programmed to adjust the controlled supply rate so as not to decrease the controlled supply rate as a function of a decrease in the out-feed rate.

29. The apparatus of claim 23 further comprising a web supply for providing separated individual sheets to the sheet supply device.

30. The apparatus of 29 further comprising a burster for bursting sheets from the web supply to create separated individual sheets.

31. The apparatus of claim 29 further comprising a web cutter for separating side-by-side web sheets from the web supply.

32. The apparatus of claim 29 wherein the sheet supply device supplies individual sheets from the web supply disposed substantially atop one another to the stacking device.

33. The apparatus of claim 23 further comprising an accumulating device downstream from the stacking device for accumulating a predetermined number of sheets fed from the stacking device.

34. The apparatus of claim 23 wherein the feeding device feeds from the sheet stack individual sheets in groups comprising of one or more sheets whereby each sheet in a group is in seriatim with one another and each sheet is separated from one another by a first predetermined distance.

35. The apparatus of claim 34, wherein the feeding device separates each sheet group from one another by a second predetermined distance.

36. The apparatus of claim 34, comprising a rotating feed drum for feeding sheets from the stacking device.

37. The apparatus of claim 36, wherein the rotating feed drum is constantly rotating.

38. The apparatus of claim 37, the rotating feed drum further includes a vacuum source for causing a sheet to adhere against the rotating feed drum.

39. The apparatus of claim 37, wherein the feed drum further includes an inner valve cylinder rotatably disposed within the feed drum between an actuated position for causing a vacuum to be drawn in the feed drum such that a sheet adheres against the rotating feed drum and a default position for terminating the vacuum being drawn in the feed drum.

40. The apparatus of claim 39, wherein the vacuum source provides a constant vacuum to the inner valve cylinder.

41. The apparatus of claim 23 wherein the out-feed sensor is an optical sensor.

42. A method for feeding sheets of paper to an inserter system, comprising the steps of:

supplying individual sheets at a controlled supply rate from a sheet supplying device;

receiving the individual sheets in a sheet stacking device from the sheet supplying device;

stacking the individual sheets in the stacking device;

feeding individual sheets from the sheet stack in the stacking device to another device in the inserter system coupled downstream to the sheet stacking device;

monitoring a variable out-feed rate at which individual sheets are fed from the sheet stack;

monitoring a height of the sheet stack;

comparing the height of the sheet stack to a predetermined nominal height;

if the height of the sheet stack is greater than the predetermined nominal height, adjusting the controlled supply rate to be less than the variable out-feed rate;

if the height of the sheet stack is less than the predetermined nominal height, adjusting the controlled supply rate to be greater than the variable out-feed rate;

comparing the height of the sheet stack to a predetermined maximum height;

comparing the height of the sheet stack to a predetermined minimum height;

if the height of the sheet stack is greater than the maximum height, adjusting the controlled supply rate to zero;

if the height of the sheet stack is less than the minimum height, adjusting the controlled supply rate to a maximum supply rate;

determining a height difference between the predetermined nominal height and the height of the sheet stack; and wherein a magnitude of adjustments to the controlled supply rate relative to the out-feed rate is a function of the height difference, the function defining a relationship whereby the greater the height difference, the greater the magnitude of the adjustment; and further including the step of adjusting the controlled supply rate to a default supply rate if no out-feed rate exists and if the sheet stack is below the predetermined nominal height.

43. A sheet feeding apparatus for feeding sheets of paper to an inserter system, the apparatus comprising:

a sheet supply device for supplying individual sheets at a controlled supply rate;

a sheet stacking device receiving individual sheets from the sheet supplying device, the individual sheets forming a sheet stack in the stacking device;

a feeding device for feeding individual sheets from the sheet stack in the stacking device to another device in the inserter system coupled downstream of the sheet stacking device;

an out-feed sensor for detecting a variable out-feed rate at which individual sheets are fed from the sheet stack;

a stack height monitoring device for sensing a height of the sheet stack;

a processor coupled to the out-feed sensor and the stack height monitoring device, the processor programmed to control the controlled supply rate from the sheet supplying device, the processor further being programmed to compare the height of the sheet stack to a predetermined nominal height and adjusting the controlled supply rate as follows:

if the height of the sheet stack is greater than the predetermined nominal height, adjusting the controlled supply rate to be less than the variable out-feed rate;

if the height of the sheet stack is less than the predetermined nominal height, adjusting the controlled supply rate to be greater than the variable out-feed rate;

wherein the processor is further programmed to adjust the controlled supply rate to match the variable out-feed rate, if the height of the sheet stack is the predetermined nominal height;

wherein the processor is further programmed to:

compare the height of the sheet stack to a predetermined maximum height;

compare the height of the sheet stack to a predetermined minimum height;

if the height of the sheet stack is equal to or greater than the maximum height, adjust the controlled supply rate to zero;

if the height of the sheet stack is equal to or less than the minimum height, adjust the controlled supply rate to a maximum supply rate;

wherein the processor is further programmed to determine a height difference between the predetermined nominal height and the height of the sheet stack; and wherein a magnitude of adjustments to the controlled supply rate relative to the out-feed rate is a function of the height difference, the function defining a relationship whereby the greater the height difference, the greater the magnitude of the adjustment; and wherein the processor is further programmed to adjust the controlled supply rate to a default supply rate if no out-feed rate exists and if the sheet stack is below the predetermined nominal height.

* * * * *